US012604926B2

(12) United States Patent
Batista et al.

(10) Patent No.: US 12,604,926 B2
(45) Date of Patent: Apr. 21, 2026

(54) AEROSOL-GENERATING ARTICLE WITH PLUG SEGMENTS FLANKING AN AEROSOL-GENERATING ELEMENT

(71) Applicant: Philip Morris Products S.A., Neuchatel (CH)

(72) Inventors: Rui Nuno Rodrigues Alves Batista, Morges (CH); Valerio Oliana, Pully (CH); Alexandra Sereda, Neuchatel (CH); Gianluca Bongiovanni, Boudry (CH); Bekele Alemu Bedasso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 454 days.

(21) Appl. No.: 18/262,836

(22) PCT Filed: Feb. 2, 2022

(86) PCT No.: PCT/EP2022/052505
§ 371 (c)(1),
(2) Date: Jul. 25, 2023

(87) PCT Pub. No.: WO2022/167495
PCT Pub. Date: Aug. 11, 2022

(65) Prior Publication Data

US 2024/0306703 A1 Sep. 19, 2024

(30) Foreign Application Priority Data

Feb. 2, 2021 (EP) ..... 21154831

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/02* (2013.01); *A24D 1/045* (2013.01); *A24D 3/17* (2020.01); *A24F 40/20* (2020.01)

(58) Field of Classification Search
None
See application file for complete search history.

(56) References Cited

U.S. PATENT DOCUMENTS 5,499,636 A 3/1996 Baggett, Jr. et al.
5,692,526 A 12/1997 Adams et al.
(Continued)

FOREIGN PATENT DOCUMENTS

CN 111629611 A 9/2020
EP 0 822 670 B1 11/2005
(Continued)

OTHER PUBLICATIONS

Translation of KR2020 0061290A, Google Patents, [online], retrieved from the Internet, [retrieved Dec. 6, 2025, <URL:https://patents.google.com/patent/KR20200061290A/en> (Year: 2025).*
(Continued)

*Primary Examiner* — Dennis R Cordray
(74) *Attorney, Agent, or Firm* — Oblon, McClelland, Maier & Neustadt, L.L.P.

(57) ABSTRACT

An aerosol-generating article is provided for producing an inhalable aerosol upon heating, the article including: first and second plug segments each including a solid cross-section of material; the second segment being a filter plug segment and is permeable; an aerosol-generating element positioned immediately between the first and the second segments, the second segment being located downstream of the aerosol-generating element; and a wrapper circumscribing the first plug segment, the aerosol-generating element, and the second plug segment, a portion of the wrapper
(Continued)

circumscribing the aerosol-generating element being air permeable such that the wrapper establishes a fluid communication between an exterior of the article and the aerosol-generating element, and an air permeability of the permeable portion of the wrapper being greater than 2500 Coresta units and less than 12000 Coresta units.

17 Claims, 3 Drawing Sheets

(51) Int. Cl.

| | |
|---|---|
| ***A24D 1/04*** | (2006.01) |
| ***A24D 3/17*** | (2020.01) |
| ***A24F 40/20*** | (2020.01) |

(56) References Cited

U.S. PATENT DOCUMENTS

| | | | |
|---|---|---|---|
| 9,894,930 | B2 | 2/2018 | Bonici et al. |
| 10,165,794 | B2 | 1/2019 | Besso et al. |
| 2014/0345634 | A1 | 11/2014 | Zuber et al. |
| 2020/0113227 | A1 | 4/2020 | Mclaughlin et al. |
| 2021/0030056 | A1 | 2/2021 | Hwang et al. |

FOREIGN PATENT DOCUMENTS

| | | | |
|---|---|---|---|
| JP | 2004-516814 | A | 6/2004 |
| JP | 2015-503337 | A | 2/2015 |
| JP | 2019-512235 | A | 5/2019 |
| JP | 2020-511998 | A | 4/2020 |
| JP | 2020-520678 | A | 7/2020 |
| JP | 2020-522241 | A | 7/2020 |
| JP | 2021-511797 | A | 5/2021 |
| JP | 2022-502013 | A | 1/2022 |
| KR | 10-2020-0061290 | A | 6/2020 |
| RU | 2 609 191 | C2 | 1/2017 |
| WO | WO 2015/176898 | A1 | 11/2015 |
| WO | WO 2019/110747 | A1 | 6/2019 |
| WO | WO 2020/002910 | A1 | 1/2020 |
| WO | WO 2020/105930 | A1 | 5/2020 |
| WO | WO 2020/115151 | A1 | 6/2020 |
| WO | WO 2021/165502 | A2 | 8/2021 |
| WO | WO 2022/074156 | A1 | 4/2022 |

OTHER PUBLICATIONS

International Search Report & Written Opinion issued May 10, 2022 in PCT/EP2022/052505 filed on Feb. 2, 2022, 11 pages.

International Preliminary Report on Patentability & Written Opinion issued Apr. 19, 2023 in in PCT/EP2022/052505 filed on Feb. 2, 2022, 12 pages.

Russian Notice of Allowance and Search Report issued May 16, 2025, in corresponding Russian Patent Application No. 2023122726/03(050033), (with English Translation of Category of Cited Documents), 11 pages.

Extended European Search Report issued on Jul. 20, 2021 in European Patent Application No. 21154831.8, 9 pages.

Office Action dated Jan. 26, 2026, issued in corresponding Japanese Patent Application No. 2023-544748 (with English translation).

* cited by examiner

AEROSOL-GENERATING ARTICLE WITH PLUG SEGMENTS FLANKING AN AEROSOL-GENERATING ELEMENT

The present invention relates to an aerosol-generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor arranged within the aerosol-generating substrate have been proposed by WO 2015/176898. A further alternative has been described in WO 2020/115151, which discloses an aerosol-generating article used in combination with an external heating system comprising one or more heating elements arranged around the periphery of the aerosol-generating article. For example, external heating elements may be provided in the form of flexible heating foils on a dielectric substrate, such as polyimide.

Aerosol-generating articles in which an aerosol-forming (or aerosol-generating) substrate, such as a tobacco-containing substrate, is heated rather than combusted present a number of challenges that were not encountered with conventional smoking articles. Current articles are designed for use in devices having heaters that are configured to externally heat an aerosol-forming substrate and to draw air primarily through the aerosol-forming substrate in an axial or longitudinal direction. However, the present inventors have found that it may be highly beneficial to allow flexibility in managing the combination of axial and radial air entering into the article, which would potentially result in improved aerosol delivery for an end user when the article is used with an externally heating device or aerosol-generating device. Particularly in the context of external heaters surrounding at least a portion of the aerosol-generating substrate when the article is received within an aerosol-generating device, designing an article such that air can at least enter the article through the outside of the substrate that is being heated, instead or in addition to air entering the article via the upstream end, is found to be desirable.

Further, it would be desirable to provide one such aerosol-generating rod or article that can be manufactured efficiently and at high speed without the need for extensive modification of existing equipment. It would also be desirable to provide a novel and improved aerosol-generating rod or article capable of more promptly providing a satisfactory aerosol delivery to the user and enables a finer tuning of the aerosol delivery during use, as a whole. It would be especially desirable to provide one such novel and improved aerosol-generating rod or article that can generate a satisfactory aerosol delivery to the user at lower temperatures while still heating the tobacco-containing substrate for regular consumption.

The present disclosure relates to an aerosol-generating rod or article for producing an inhalable aerosol upon heating. The aerosol-generating rod or article may comprise a first segment. The aerosol-generating rod or article may comprise a second segment. The aerosol-generating rod or article may comprise an aerosol-generating element. The aerosol-generating rod or article may comprise a wrapper. The second segment may be permeable, preferably air permeable. The aerosol-generating element may be positioned between the first segment and the second segment. The second segment may be located downstream of the aerosol-generating element. The wrapper may circumscribe the first segment, the aerosol-generating element and the second segment. A portion of the wrapper circumscribing the aerosol-generating element may be air permeable such that the wrapper establishes a fluid communication between the exterior of the aerosol-generating article and the aerosol-generating element.

The first segment may be a first plug segment. The second segment may be a second plug segment. The first segment may also be referred to as the upstream segment. The second segment may also be referred to as the downstream segment.

The aerosol-generating element may be positioned downstream of the first segment. The aerosol-generating element may be positioned immediately downstream of the first segment. The second segment may be positioned immediately downstream of the aerosol-generating element. The aerosol-generating element may be positioned immediately between the first segment and the second segment. The first plug segment may abut the aerosol-generating element. The second plug segment may abut the aerosol-generating element. The first plug segment, the aerosol-generating element (or substrate) and the second plug segment may be in axial alignment with each other. The first plug segment, the aerosol-generating element (or substrate) and the second plug segment may be arranged sequentially.

According to the present invention, there is provided an aerosol-generating article or rod for producing an inhalable aerosol upon heating. The aerosol-generating article or rod comprises a first plug segment, a second plug segment, an aerosol-generating element and a wrapper. The second plug segment is permeable, preferably air permeable. The aerosol-generating element is positioned immediately between the first segment (plug segment) and the second segment (plug segment). The second plug segment is located downstream of the aerosol-generating element. The wrapper circumscribes the first plug segment, the aerosol-generating element and the second plug segment. A portion of the wrapper circumscribing the aerosol-generating element is air permeable such that the wrapper establishes a fluid communication between the exterior of the aerosol-generating article or rod and the aerosol-generating element.

The present invention and disclosure provides a novel and compact aerosol-generating rod or article configuration that allows for flexible control over the air intake into the aerosol-generating element. By providing two plug segments on either side of an aerosol-generating element and a wrapper that is air permeable (or porous) at least where it overlaps the aerosol-generating element, the amount of air entering the aerosol-generating element from an axial direction, via the upstream plug, and from a radial or transverse direction, via the air permeable portion of the wrapper, can be readily controlled by adjusting the permeability characteristics of the first, upstream plug segment and the wrapper. Having the aerosol-generating element immediately between the first and second plug segment further ensures that the permeability characteristics of the plug segments significantly influence the aerosol delivery to a user.

By at least establishing a fluid communication between the exterior of article and the aerosol-generating element through an air permeable wrapper, ensures that air enters directly into the aerosol-generating element without having to flow through any other components upstream of the article and the aerosol-generating element. In the context of externally heating devices, the air flowing directly into the aerosol-generating element will be partially heated as it flows through or past the external heater. This will essentially allow for a quicker and more efficient heating of the aerosol-generating element, as the air entering via the wrapper will likely be warmer than the air entering the upstream end of the article in a substantially axial direction, thereby mitigating for any initial delay in aerosol generation and delivery that is found in existing aerosol-generating articles and systems when a user is initiating consumption.

Furthermore, providing two segments flanking each side of an aerosol-generating element ensures that any debris or segments of the aerosol-generating element is prevented from exiting either side of the aerosol-generating article. This benefit is further enhanced by providing the segments immediately flanking each side of the aerosol-generating element, as this ensures that the contents of the aerosol-generating element are maintained in their original location and cannot move to other locations of the article, or escape the article or rod.

According to the present disclosure, there is provided an aerosol-generating article or rod for producing an inhalable aerosol upon heating. The aerosol-generating article or rod may comprise a first plug segment, a second plug segment, an aerosol-generating element and a wrapper. The second plug segment may be permeable. The aerosol-generating element may be positioned immediately between the first segment (plug segment) and the second segment (plug segment). The second plug segment may be located downstream of the aerosol-generating element. The wrapper may circumscribe the first plug segment, the aerosol-generating element and the second plug segment. A portion of the wrapper circumscribing the aerosol-generating element may be air permeable. The air permeability of the permeable portion of the wrapper may be at least about 2500 Coresta Units. The air permeability of the permeable portion of the wrapper may be at least about 5000 Coresta Units.

The term "aerosol-generating article" is used herein to denote an article wherein an aerosol-generating substrate is heated to produce and deliver an inhalable aerosol to a user. As used herein, the term "aerosol-generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating a flavour generating substrate, such as tobacco. Known heated aerosol-generating articles include, for example, electrically heated aerosol-generating articles and aerosol-generating articles in which an aerosol is generated by the transfer of heat from a combustible fuel element or heat source to a physically separate aerosol-forming material. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in EP 0822670.

As used herein, the term "aerosol-generating device" refers to a device comprising a heater or heating element that interacts with the aerosol-generating (or aerosol-forming) substrate of the aerosol-generating article to generate an aerosol.

As used herein with reference to the present invention, the term "rod" is used to denote a generally elongate element, preferably a cylindrical element of substantially circular, oval or elliptical cross-section. The aerosol-generating article of the present invention may also be referred throughout the present disclosure as an aerosol-generating rod. The aerosol-generating article of the present invention may comprise an aerosol-generating rod and a downstream section downstream of the rod. The downstream section may also be referred to as the "filter" of the aerosol-generating article. Within the present disclosure, the term "aerosol-generating rod" refers to the portion of the article comprising, or consisting of, the aerosol-generating element and the two flanking (plug) segments.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

As mentioned above, the aerosol-generating article may further comprise a downstream section at a location downstream of the aerosol-generating rod. The downstream section may comprise one or more downstream elements.

The downstream section may comprise a hollow section between the mouth end of the aerosol-generating article and the aerosol-generating rod. The hollow section may comprise a hollow tubular element.

As used herein, terms such as "hollow tubular segment" and "hollow tubular element" are used to denote a generally elongate element defining a lumen or airflow passage along a longitudinal axis thereof. In particular, the term "tubular" will be used in the following with reference to an element or segment having a substantially cylindrical cross-section and defining at least one airflow conduit establishing an uninterrupted fluid communication between an upstream end of the tubular element or segment and a downstream end of the tubular element or segment. However, it will be understood that alternative geometries (for example, alternative cross-sectional shapes) of the tubular element or segment may be possible.

The term "immediate" or "immediately" preferably refers to two components adjacent to each other with no space or gaps in between them.

In the context of the present invention a hollow tubular segment or hollow tubular element provides an unrestricted flow channel. This means that the hollow tubular segment or hollow tubular element provides a negligible level of resistance to draw (RTD). The term "negligible level of RTD" is used to describe an RTD of less than 1 mm $H_2O$ per 10 millimetres of length of the hollow tubular segment or hollow tubular element, preferably less than 0.4 mm $H_2O$ per 10 millimetres of length of the hollow tubular segment or hollow tubular element, more preferably less than 0.1 mm $H_2O$ per 10 millimetres of length of the hollow tubular segment or hollow tubular element.

The flow channel should therefore be free from any components that would obstruct the flow of air in a longitudinal direction. Preferably, the flow channel is substantially empty.

In the present specification, a "hollow tubular segment" or "hollow tubular element" may also be referred to as a "hollow tube" or a "hollow tube segment".

The aerosol-generating article may further comprise an upstream section at a location upstream of the aerosol-generating rod. The upstream section may comprise one or more upstream elements. The upstream section may comprise an upstream element arranged immediately upstream of the aerosol-generating rod; that is, immediately upstream of the first plug segment.

An aerosol-generating rod or article in accordance with the present invention may be substantially cylindrical and may have an external diameter of at least about 4 millimetres. More preferably, the aerosol-generating rod has an external diameter of at least about 5 millimetres. Even more preferably, the aerosol-generating rod has an external diameter of at least about 6 millimetres.

The aerosol-generating rod preferably has an external diameter of less than or equal to about 12 millimetres. More preferably, the aerosol-generating rod has an external diameter of less than or equal to about 11 millimetres. Even more preferably, the aerosol-generating rod has an external diameter of less than or equal to about 8 millimetres.

The aerosol-generating rod may have an external diameter from about 4 millimetres to about 12 millimetres, preferably from 5 millimetres to about 12 millimetres, more preferably from about 6 millimetres to about 12 millimetres. The aerosol-generating rod may have an external diameter from about 4 millimetres to about 11 millimetres, preferably from 5 millimetres to about 11 millimetres, more preferably from about 6 millimetres to about 11 millimetres. The aerosol-generating rod may have an external diameter from about 4 millimetres to about 8 millimetres, preferably from 5 millimetres to about 8 millimetres, more preferably from about 6 millimetres to about 8 millimetres.

In general, it has been observed that the smaller the diameter of a rod-shaped element comprising aerosol-generating substrate, the lower the temperature that is required to raise a core temperature of the rod-shaped element such that sufficient amounts of vaporizable species are released from the aerosol-generating substrate to form a desired amount of aerosol. At the same time, without wishing to be bound by theory, it is understood that a smaller diameter of the rod-shaped element allows for a faster penetration of heat supplied to the aerosol-generating rod into its entire volume. Nevertheless, where the diameter of the rod-shaped element is too small, a volume-to-surface ratio of the aerosol-generating substrate becomes less favourable, as the amount of available aerosol-forming substrate diminishes. This is particularly important for aerosol-generating articles configured to be heated by an external heater.

A diameter of the aerosol-generating rod falling within the ranges described herein is particularly advantageous in terms of a balance between energy consumption and aerosol delivery. This advantage is felt in particular when an aerosol-generating article comprising an aerosol-generating rod having a diameter as described herein is used in combination with an external heater arranged around the periphery of the aerosol-generating rod or article. Under such operating conditions, it has been observed that less thermal energy is required to achieve a sufficiently high temperature at the core of the aerosol-generating rod or at the core of the article comprising the rod. Thus, when operating at lower temperatures, a desired target temperature at the core of the aerosol-generating rod may be achieved within a desirably reduced time frame and by a lower energy consumption.

An overall length of the aerosol-generating rod may be at least about 8 millimetres. Preferably, an overall length of the aerosol-generating rod is at least about 9 millimetres. More preferably, an overall length of the aerosol-generating rod is at least about 10 millimetres.

An overall length of the aerosol-generating rod is preferably less than or equal to about 27 millimetres. More preferably, an overall length of the aerosol-generating rod is preferably less than or equal to about 23 millimetres. Even more preferably, an overall length of the aerosol-generating rod is preferably less than or equal to about 19 millimetres.

An overall length of the aerosol-generating rod may be from about 8 millimetres to about 27 millimetres, preferably from about 9 millimetres to about 27 millimetres, more preferably from about 10 millimetres to about 27 millimetres. An overall length of the aerosol-generating rod may be from about 8 millimetres to about 23 millimetres, preferably from about 9 millimetres to about 23 millimetres, more preferably from about 10 millimetres to about 23 millimetres. An overall length of the aerosol-generating rod may be from about 8 millimetres to about 19 millimetres, preferably from about 9 millimetres to about 19 millimetres, more preferably from about 10 millimetres to about 19 millimetres.

The plug segments of the present disclosure may have the same external diameter as the external diameter of the aerosol-generating element. Preferably, a plug segment comprises a solid cross-section of material. In other words, the plug segment does not define any cavity, gaps or voids, apart from those already defined by the material properties itself, such as pores. This ensures that the plug segments hinder the inadvertent exit of aerosol-generating element material from the article.

The plug segment may have one or more apertures or through holes defined through the length of the plug segment. The number and location of apertures or through holes may depend of the nature of the aerosol-generating element. Providing such apertures ensures that the resistance to draw (RTD) of the article is beneficially low. Either one or both of the first and second plug segments may be comprise such apertures or through holes. Such apertures may each define a cavity within the plug segment. The plug segment may be a hollow tubular segment, preferably having a relatively thick wall.

The first, upstream plug segment may be substantially impermeable. The first plug segment may be substantially air impermeable, so that air may not pass through the first plug segment material and into the aerosol-generating element or segment. The material of the first, upstream plug segment may be substantially impermeable. As a result, air may not flow into the aerosol-generating rod or article via its upstream end and may mainly enter the aerosol-generating article through the permeable or porous portion or region of the wrapper.

The first, upstream plug segment may be substantially permeable. The material of the first, upstream plug segment may be substantially permeable. The first plug segment may be substantially air permeable (or porous), so that air may pass through the first plug segment material and into the aerosol-generating element or segment. As a result, air may flow into the aerosol-generating rod or article via its upstream end and may also enter the aerosol-generating article through the permeable or porous portion or region of the wrapper.

Unless otherwise specified, the resistance to draw (RTD) of a component or the aerosol-generating article or rod may be measured in accordance with ISO 6565-2015. The RTD refers the pressure required to force air through the full length of a component. The terms "pressure drop" or "draw resistance" of a component or article may also refer to the "resistance to draw". Such terms generally refer to the measurements in accordance with ISO 6565-2015 are normally carried out at under test at a volumetric flow rate of about 17.5 millilitres per second at the output or downstream end of the measured component at a temperature of about 22 degrees Celsius, a pressure of about 101 kPa (about 760 Torr) and a relative humidity of about 60%.

The resistance to draw per unit length of a particular component (or element) of the aerosol-generating article, such as the first plug segment, the aerosol-generating element or the second plug segment, can be calculated by dividing the measured resistance to draw of the component by the total axial length of the component. The RTD per unit length refers to the pressure required to force air through a unit length of a component. Throughout the present disclosure, a unit length refers to a length of 1 mm. Accordingly, in order to derive the RTD per unit length of a particular component, a specimen of a particular length, 15 mm for example, of the component can be used in measurement. The RTD of such a specimen is measured in accordance with ISO 6565-2015. If, for example, the measured RTD is about 15 mm $H_2O$, then the RTD per unit length of the component is about 1 mm $H_2O$ per mm. The RTD per unit length of the component is dependent on the structural properties of the material used for the component as well as the cross-sectional geometry or profile of the component, amongst other factors.

The relative RTD, or RTD per unit length, of the first plug segment or second plug segment may be between about 0 mm $H_2O$ per mm and about 3 mm $H_2O$ per mm. The RTD per unit length of the first plug segment or second plug segment may be between about 0 mm $H_2O$ per mm and about 2.5 mm $H_2O$ per mm. The RTD per unit length of the first plug segment or second plug segment may be between about 0 mm $H_2O$ per mm and about 2 mm $H_2O$ per mm. The RTD per unit length of the first plug segment or second plug segment may be between about 0 mm $H_2O$ per mm and about 1 mm $H_2O$ per mm. The RTD per unit length of the first plug segment or second plug segment may be between about 0 mm $H_2O$ per mm and about 0.75 mm $H_2O$ per mm.

As mentioned above, the relative RTD, or RTD per unit length, of the first plug segment or second plug segment may be greater than about 0 mm $H_2O$ per mm and less than about 3 mm $H_2O$ per mm. The RTD per unit length of the first plug segment or second plug segment may be greater than about 0 mm $H_2O$ per mm and less than about 2.5 mm $H_2O$ per mm. The RTD per unit length of the first plug segment or second plug segment may be greater than about 0 mm $H_2O$ per mm and less than about 2 mm $H_2O$ per mm. The RTD per unit length of the first plug segment or second plug segment may be greater than about 0 mm $H_2O$ per mm and less than about 1 mm $H_2O$ per mm. The RTD per unit length of the first plug segment or second plug segment may be greater than about 0 mm $H_2O$ per mm and less than about 0.75 mm $H_2O$ per mm.

The RTD per unit length of the first plug segment or second plug segment may be greater or equal to about 0 mm $H_2O$ per mm. Thus, the RTD per unit length of the first plug segment or second plug segment may be between about 0 mm $H_2O$ per mm and about 3 mm $H_2O$ per mm.

The RTD per unit length of the first plug segment or second plug segment may be between about 0 mm $H_2O$ per mm and about 2.5 mm $H_2O$ per mm. The RTD per unit length of the first plug segment or second plug segment may be between about 0 mm $H_2O$ per mm and about 2 mm $H_2O$ per mm. The RTD per unit length of the first plug segment or second plug segment may be between about 0 mm $H_2O$ per mm and about 1 mm $H_2O$ per mm. The RTD per unit length of the first plug segment or second plug segment may be between about 0 mm $H_2O$ per mm and about 0.75 mm $H_2O$ per mm.

The resistance to draw of the first plug segment or second plug segment may be greater than or equal to about 0 mm $H_2O$ and less than about 10 mm $H_2O$. The resistance to draw of the first plug segment or second plug segment may be greater than 0 mm $H_2O$ and less than about 5 mm $H_2O$. The resistance to draw of the first plug segment or second plug segment may be greater than 0 mm $H_2O$ and less than about 2 mm $H_2O$. The resistance to draw of the first plug segment or second plug segment may be greater than 0 mm $H_2O$ and less than about 1 mm $H_2O$.

The RTD properties of the first plug segment and the second plug segment may be the same. The RTD properties of the first plug segment and the second plug segment may be different. For example, if they are different, the RTD (or RTD per unit length) of the second plug segment is preferably lower than the RTD (or RTD per unit length) of the first plug segment. In this manner, the second plug segment functions to provide a barrier to prevent the dislodging of aerosol-generating element material while not increasing the RTD of the article substantially.

An external diameter of the first plug segment may be substantially the same as an external diameter of the rod.

The first plug segment may have a length of at least about 2 millimetres. Preferably, the first plug segment has a length of at least about 3 millimetres. More preferably, the first plug segment has a length of at least about 4 millimetres.

The first plug segment may have a length of up to about 10 millimetres. Preferably, the first plug segment has a length of less than or equal to about 7 millimetres. More preferably, the first plug segment has a length of less than or equal to about 5 millimetres.

The first plug segment may have a length from about 2 millimetres to about 10 millimetres, preferably from about 3 millimetres to about 10 millimetres, more preferably from about 4 millimetres to about 10 millimetres. The first plug segment may have a length from about 2 millimetres to about 17 millimetres, preferably from about 3 millimetres to about 7 millimetres, more preferably from about 4 millimetres to about 7 millimetres. The first plug segment may have a length from about 2 millimetres to about 5 millimetres, preferably from about 3 millimetres to about 5 millimetres, more preferably from about 4 millimetres to about 5 millimetres.

In an aerosol-generating rod or article in accordance with the present invention, a ratio between a length of the first plug segment and a length of the aerosol-generating element is at least about 0.15. Preferably, a ratio between a length of the first plug segment and a length of the aerosol-generating element is at least about 0.2. More preferably, a ratio between a length of the first plug segment and a length of the aerosol-generating element is at least about 0.3.

A ratio between a length of the first plug segment and a length of the aerosol-generating element is preferably less than or equal to about 0.5. More preferably, a ratio between a length of the first plug segment and a length of the aerosol-generating element is less than or equal to about 0.45. Even more preferably, a ratio between a length of the first plug segment and a length of the aerosol-generating element is less than or equal to about 0.4.

A ratio between a length of the first plug segment and a length of the aerosol-generating element may be from about 0.15 to about 0.5, preferably from about 0.2 to about 0.5, more preferably from about 0.3 to about 0.5. A ratio between a length of the first plug segment and a length of the aerosol-generating element may be from about 0.15 to about 0.45, preferably from about 0.2 to about 0.45, more preferably from about 0.3 to about 0.45. A ratio between a length of the first plug segment and a length of the aerosol-generating element may be from about 0.15 to about 0.4, preferably from about 0.2 to about 0.4, more preferably from about 0.3 to about 0.4.

The second, downstream plug segment or the first, upstream plug segment may comprise a plug of a porous substrate. The plug of porous substrate may be substantially free of any aerosol-generating compounds.

The first plug segment or the second plug segment may be formed of a fibrous material. The first plug segment or the second plug segment may be formed of a porous material. The first plug segment or the second plug segment may be formed of a fluid or air permeable material. The first plug segment or the second plug segment may be formed of a fluid or air impermeable material. The first plug segment or the second plug segment may be formed of a biodegradable material. The first plug segment or the second plug segment may be formed of a cellulose material, such as cellulose acetate. For example, a first plug segment or the second plug segment may be formed from a bundle of cellulose acetate fibres having a denier per filament between about 10 and about 15. For example, a first plug segment or the second plug segment formed from relatively low density cellulose acetate tow, such as cellulose acetate tow comprising fibres of about 12 denier per filament, which may provide an RTD per unit length between about 0.8 and about 2.5 mm $H_2O$ per mm.

The first plug segment or the second plug segment may be formed of a polylactic acid based material. The first plug segment or the second plug segment may be formed of a bioplastic material, preferably a starch-based bioplastic material. The first plug segment or the second plug segment may be made by injection moulding or by extrusion. Bioplastic-based materials are advantageous because they are able to provide first plug segment or the second plug segment structures which are simple and cheap to manufacture with a particular and complex cross-sectional profile, which may comprise a plurality of relatively large air flow channels extending through the first plug segment or the second plug segment material, that provides suitable RTD characteristics.

The first plug segment or the second plug segment may be formed from a sheet of suitable material that has been crimped, pleated, gathered, woven or folded into an element that defines a plurality of longitudinally extending channels. Such sheet of suitable material may be formed of paper, cardboard, and a polymer, such as polylactic acid, or any other cellulose-based, paper-based material or bioplastic-based material. A cross-sectional profile of such a first plug segment or the second plug segment may show the channels as being randomly oriented.

The first plug segment or the second plug segment may be formed in any other suitable manner. For example, the first plug segment or the second plug segment may be formed from a bundle of longitudinally extending tubes. The longitudinally extending tubes may be formed from polylactic acid. The first plug segment or the second plug segment may be formed by extrusion, moulding, lamination, injection, or shredding of a suitable material. Thus, it is preferred that there is a low-pressure drop (or RTD) from an upstream end of the first plug segment or the second plug segment to a downstream end of the first plug segment or the second plug segment.

Advantageously, the plug segments support the aerosol-generating segment or element and may help prevent any of the aerosol-generating material, such as tobacco material, contained in the aerosol-generating segment from becoming dislodged. Further, the plug segments contribute to the overall structural strength of the rod and facilitates handling thereof, particularly during manufacture.

Preferably, the second (downstream) plug segment substantially does not contribute substantially to an overall RTD of the aerosol-generating rod.

An external diameter of the second plug segment may be substantially the same as an external diameter of the rod. An external diameter of the second plug segment may be substantially the same as an external diameter of the first plug segment.

The second plug segment may have a length of at least about 2 millimetres. Preferably, the second plug segment has a length of at least about 3 millimetres. More preferably, the second plug segment has a length of at least about 4 millimetres.

The second plug segment may have a length of up to about 10 millimetres. Preferably, the second plug segment has a length of less than or equal to about 7 millimetres. More preferably, the second plug segment has a length of less than or equal to about 5 millimetres.

The second plug segment may have a length from about 2 millimetres to about 10 millimetres, preferably from about 3 millimetres to about 10 millimetres, more preferably from about 4 millimetres to about 10 millimetres. The second plug segment may have a length from about 2 millimetres to about 17 millimetres, preferably from about 3 millimetres to about 7 millimetres, more preferably from about 4 millimetres to about 7 millimetres. The second plug segment may have a length from about 2 millimetres to about 5 millimetres, preferably from about 3 millimetres to about 5 millimetres, more preferably from about 4 millimetres to about 5 millimetres.

Components of the aerosol-generating rod that will be described in more detail are circumscribed by a wrapper, which may be a paper wrapper or a non-paper wrapper. One such wrapper may also align or attach the components of the aerosol-generating rod or article to each other.

Suitable paper wrappers for use in the present invention (or arrangements of the present disclosure) are known in the art and include, but are not limited to: cigarette papers; and filter plug wraps. Suitable non-paper wrappers for use in the present invention (or arrangements of the present disclosure) are known in the art and include, but are not limited to sheets of homogenised tobacco materials.

As discussed above, a wrapper or wrapping material circumscribes the first plug segment, the aerosol-generating element and the second plug segment. The wrapper comprises a substantially permeable region or portion. The permeable region or portion overlaps or overlays at least a portion of the aerosol-generating element. The permeable region of the wrapper is configured to establish a fluid communication between the exterior of the aerosol-generating article and the aerosol-generating element. The permeable region or portion is preferably a substantially air permeable region or portion.

The permeable region of the wrapper may partially or entirely circumscribe the outer perimeter or circumference of the aerosol-generating element.

The permeable region of the wrapper may overlie at least about 10 percent of the outer surface of the aerosol-generating element. The permeable region of the wrapper may overlie at least about 20 percent of the outer surface of the aerosol-generating element. The permeable region of the wrapper may overlie at least about 25 percent of the outer surface of the aerosol-generating element. The permeable region of the wrapper may overlie at least about 40 percent of the outer surface of the aerosol-generating element. The permeable region of the wrapper may overlie at least about 50 percent of the outer surface of the aerosol-generating element. The permeable region of the wrapper may overlie at least about 60 percent of the outer surface of the aerosol-generating element. The permeable region of the wrapper may overlie at least about 75 percent of the outer surface of the aerosol-generating element. The permeable region of the wrapper may overlie at least about 80 percent of the outer surface of the aerosol-generating element. Preferably, the permeable region of the wrapper may overlie or overlap the entire outer surface of the aerosol-generating element.

Preferably, the entire permeable portion (or region) of the wrapper overlaps or overlies the aerosol-generating element. Preferably, the rest of the wrapper is not permeable. Preferably, the portion, or portions, of the wrapper that does not overlap or overlie the aerosol-generating element is not permeable. Preferably, the wrapper comprises the permeable portion (or region) and an impermeable portion.

The length of the permeable portion of the wrapper may be at least about 10 percent of the length of the aerosol-generating element. The length of the permeable portion of the wrapper may be at least about 20 percent of the length of the aerosol-generating element. The length of the permeable portion of the wrapper may be at least about 25 percent of the length of the aerosol-generating element. The length of the permeable portion of the wrapper may be at least about 40 percent of the length of the aerosol-generating element. The length of the permeable portion of the wrapper may be at least about 50 percent of the length of the aerosol-generating element. The length of the permeable portion of the wrapper may be at least about 60 percent of the length of the aerosol-generating element. The length of the permeable portion of the wrapper may be at least about 75 percent of the length of the aerosol-generating element. The length of the permeable portion wrapper may be the same as the length of the wrapper itself. The length of the permeable portion of the wrapper may be at least about 80 percent of the length of the aerosol-generating element. Preferably, the length of the wrapper is the same as the length of the aerosol-generating rod or aerosol-generating article.

The surface area of the permeable portion (or region) of the wrapper may be at least about 10 percent of the outer surface of the aerosol-generating element. The surface area of the permeable portion of the wrapper may be at least about 20 percent of the outer surface of the aerosol-generating element. The surface area of the permeable portion of the wrapper may be at least about 25 percent of the outer surface of the aerosol-generating element. The surface area of the permeable portion of the wrapper may be at least about 40 percent of the outer surface of the aerosol-generating element. The surface area of the permeable portion of the wrapper may be at least about 50 percent of the outer surface of the aerosol-generating element. The surface area of the permeable portion of the wrapper may be at least about 60 percent of the outer surface of the aerosol-generating element. The surface area of the permeable portion of the wrapper may be at least about 75 percent of the outer surface of the aerosol-generating element. The surface area of the permeable portion of the wrapper may be at least about 80 percent of the outer surface of the aerosol-generating element. The surface area of the permeable portion of the wrapper may be the same as the outer surface of the aerosol-generating element. The surface area of the permeable portion of the wrapper may be the same as the surface area of the wrapper itself.

The permeable portion may extend around at least about 10 percent of the outer circumference or perimeter of the aerosol-generating element. The permeable portion may extend around at least about 25 percent of the outer circumference or perimeter of the aerosol-generating element. The permeable portion may extend around at least about 50 percent of the outer circumference or perimeter of the aerosol-generating element. The permeable portion may extend around at least about 75 percent of the outer circumference or perimeter of the aerosol-generating element. The permeable portion may extend around the entire outer circumference or perimeter of the aerosol-generating element. In other words, the permeable portion may entirely circumscribe the aerosol-generating element.

The inventors have found that the dimensions of the permeable region or portion of the wrapper can be optimised for different articles in conjunction with a particular range of air permeability values of the wrapper, depending on the air flow requirements of the article and it aerosol-generating substrate. For example, for certain articles and aerosol-generating substrates, it may be beneficial to provide a wrapper with a relatively large permeable region (preferably, in accordance with the present disclosure) to distribute the air intake over the aerosol-generating substrate.

In some cases, it may be beneficial to provide a wrapper with a relatively small permeable region in order to concentrate the air intake at a particular location around the aerosol-generating element. This may be advantageous for ensuring compatibility between the aerosol-generating article and devices, with which the article is arranged to be used.

The term "outer surface" preferably refers to the outer surface of an element that extends longitudinally, parallel to the longitudinal axis defined by the article. The term "outer surface" may refer to an "outer longitudinal surface".

The entire wrapper may be permeable (air permeable).

The air permeability of the permeable region of the wrapper, or of the wrapper, may be greater than about 2500 Coresta units. The air permeability of the permeable region of the wrapper, or of the wrapper, may be greater than about 5000 Coresta units. The air permeability of the permeable region of the wrapper, or of the wrapper, may be greater than about 7500 Coresta units.

The air permeability of the permeable region of the wrapper, or of the wrapper, may be less than about 12000 Coresta units. The air permeability of the permeable region of the wrapper, or of the wrapper, may be less than about 11000 Coresta units. The air permeability of the permeable region of the wrapper, or of the wrapper, may be less than about 10000 Coresta units.

The air permeability of the permeable region of the wrapper, or of the wrapper, may be at least about 2500 Coresta units. The air permeability of the permeable region of the wrapper, or of the wrapper, may be at least about 5000 Coresta units. The air permeability of the permeable region of the wrapper, or of the wrapper, may be at least about 7500 Coresta units.

The air permeability of the permeable region of the wrapper, or of the wrapper, may be about 12000 Coresta units or less. The air permeability of the permeable region of the wrapper, or of the wrapper, may be about 11000 Coresta units or less. The air permeability of the permeable region of the wrapper, or of the wrapper, may be about 10000 Coresta units or less.

The air permeability of the permeable region of the wrapper may be between about 2500 Coresta units and about 12000 Coresta units. The air permeability of the permeable region of the wrapper may be between about 5000 Coresta units and about 12000 Coresta units. The air permeability of the permeable region of the wrapper may be between about 7500 Coresta units and about 12000 Coresta units.

The air permeability of the permeable region of the wrapper may be between about 2500 Coresta units and about 11000 Coresta units. The air permeability of the permeable region of the wrapper may be between about 5000 Coresta units and about 11000 Coresta units. The air permeability of the permeable region of the wrapper may be between about 7500 Coresta units and about 11000 Coresta units.

The air permeability of the permeable region of the wrapper may be between about 2500 Coresta units and about 10000 Coresta units. The air permeability of the permeable region of the wrapper may be between about 5000 Coresta units and about 10000 Coresta units. The air permeability of the permeable region of the wrapper may be between about 7500 Coresta units and about 10000 Coresta units.

The air permeability in Coresta units is the amount of air in cubic centimetres that passes through one square centimetre of the wrapper in one minute at a constant pressure difference of one kilopascal (that is, 1 Coresta unit corresponds to an air permeability of 1 $cm^3/min \cdot cm^2$ at a pressure differential of 1 kPa). The air permeability in Coresta units may be measured in accordance with ISO 2965:2009.

Providing a wrapper with a relatively high (air) permeability advantageously ensures that the wrapper can allow a substantial amount of air to enter the aerosol-generating article to carry the aerosol generated to a user without needing air to enter via the upstream end of the article or rod.

The basis weight of the wrapper may be at least about 10 grams per square metre (gsm or g/m2). The basis weight of the wrapper may be at least 15 gsm.

The basis weight of the wrapper may be less than about 30 gsm. The basis weight of the wrapper may be less than about 25 gsm.

The basis weight of the wrapper may be between about 10 gsm and about 30 gsm. The basis weight of the wrapper may be between about 15 gsm and about 25 gsm.

The thickness of the wrapper may be at least about 0.01 mm. The thickness of the wrapper may be at least about 0.02 mm. The thickness of the wrapper may be at least about 0.03 mm.

The thickness of the wrapper may be less than about 0.1 mm. The thickness of the wrapper may be less than about 0.08 mm. The thickness of the wrapper may be less than about 0.07 mm.

The thickness of the wrapper may be between about 0.01 mm and about 0.1 mm. The thickness of the wrapper may be between about 0.02 mm and about 0.08 mm. The thickness of the wrapper may be between about 0.03 mm and about 0.07 mm.

Preferably, the aerosol-generating element is visible through the wrapper. The aerosol-general element may be at least partially visible through the wrapper. The wrapper, or at least the portion of the wrapper circumscribing the aerosol-generating element, may be substantially translucent or substantially transparent. The permeable portion of the wrapper may be substantially translucent or substantially transparent.

The term "substantially transparent" is used herein to describe a material which allows at least a sufficient proportion of incident light to pass through it so that it is possible to see through the material. In the present invention, the substantially transparent wrapper allows sufficient light to pass through it such that an underlying aerosol-generating element is visible through the wrapper. The transparency of the substantially transparent wrapper may be evaluated in accordance with ASTM D1003-13.

The wrapper may be completely transparent. A transparent portion of the wrapper may have a lower level of transparency while still transmitting sufficient light such that the aerosol-generating element is still visible. Preferably, "transparent" denotes a total percentage light transmission of 40% or more, more preferably 50% or more, even more preferably 60% or more, most preferably 70% or more, as measured using a Hunterlab Colorquest XE Spectrophotometer or an equivalent spectrophotometer. The term "translucent" refers to a material which allows some level of light to pass through, particularly with some diffusion.

Preferably, the light transmission of the portion of the wrapper circumscribing the aerosol-generating element is at least 40 percent, preferably at least 50 percent, even more preferably at least 60 percent. The wrapper being at least partially substantially transparent or translucent allows a user to see the contents of the aerosol-generating element of the article the user is about to use.

The porous or air permeable nature of the wrapping material or wrapper may enable a user to see the contents enclosed by the wrapper. For example, the wrapper may comprise (or be made from) tea bag material or a tea bag like material. The wrapper may comprise a biodegradable material. The wrapper may comprise polylactic acid (PLA). The wrapper may comprise a PLA mesh. The wrapper may comprise a material based on or formed from corn starch. The material of the wrapper may comprise a wood or vegetable fibres.

The wrapper may comprise a polymeric or plastic material that is air permeable, such as nylon. The wrapper may comprise a paper material, such as filter paper. The inventors have found that it is possible from such materials to form a wrapper that is suitably air permeable, with a relatively high permeability (as noted by the Coresta values above), while also allowing a user to see the contents of the aerosol-generating element in order to appreciate the type of aerosol-generating element the user is about to use.

The wrapper may also be impregnated with a flavourant. This way some of such wrapper flavourant may be entrained in or released into the air flowing through the air permeable wrapper into the aerosol-generating article or element. Such a flavourant may be a liquid or gel that may be applied to any other element or component of the aerosol-generating article, such as the aerosol-generating substrate defined herein.

Preferably, an external diameter of the aerosol-generating element is substantially the same as an external diameter of the rod. The aerosol-generating element may be referred to as an aerosol-generating segment or substrate.

The aerosol-generating element may have a length of at least about 5 millimetres. Preferably, the aerosol-generating element has a length of at least about 7 millimetres. More preferably, the aerosol-generating element has a length of at least about 8 millimetres.

The aerosol-generating element may have a length of up to about 25 millimetres.

Preferably, the aerosol-generating element has a length of less than or equal to about 20 millimetres. More preferably, the aerosol-generating element has a length of less than or equal to about 13 millimetres.

The aerosol-generating element may have a length from about 5 millimetres to about 25 millimetres, preferably from about 7 millimetres to about 25 millimetres, more preferably from about 8 millimetres to about 25 millimetres. The aerosol-generating element may have a length from about 5 millimetres to about 20 millimetres, preferably from about 7 millimetres to about 20 millimetres, more preferably from about 8 millimetres to about 20 millimetres. The aerosol-generating element may have a length from about 5 millimetres to about 13 millimetres, preferably from about 7 millimetres to about 13 millimetres, more preferably from about 8 millimetres to about 13 millimetres.

The aerosol-generating element is a solid aerosol-generating substrate comprising tobacco plant material. The term "tobacco plant material" is used herein to denote material forming part of any plant member of the genus *Nicotiana.*

The aerosol-generating element may comprise homogenised tobacco material.

Homogenised tobacco material is an example of "homogenised plant material". As used herein, the term "homogenised plant material" encompasses any plant material formed by the agglomeration of particles of plant. For example, sheets or webs of homogenised tobacco material for the aerosol-generating substrates of the present invention may be formed by agglomerating particles of tobacco material obtained by pulverising, grinding or comminuting one or more of tobacco leaf lamina and tobacco leaf stems. A homogenised plant material such as a homogenised tobacco material may be produced by casting, extrusion, paper making processes or other any other suitable processes known in the art.

The homogenised tobacco material can be provided in any suitable form. For example, the homogenised tobacco material may be in the form of one or more sheets. As used herein with reference to the invention, the term "sheet" describes a laminar element having a width and length substantially greater than the thickness thereof.

The homogenised tobacco material may be in the form of a plurality of pellets or granules.

The homogenised tobacco material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised tobacco material having a similar form. The strands of homogenised tobacco material may be formed from a sheet of homogenised tobacco material, for example by cutting or shredding, or by other methods, for example, by an extrusion method.

The strands may be formed in situ within the aerosol-generating element as a result of the splitting or cracking of a sheet of homogenised tobacco material during formation of the aerosol-generating element, for example, as a result of crimping. The strands of homogenised tobacco material within the aerosol-generating substrate may be separate from each other. Each strand of homogenised tobacco material within the aerosol-generating element may be at least partially connected to an adjacent strand or strands along the length of the strands. For example, adjacent strands may be connected by one or more fibres. This may occur, for example, where the strands have been formed due to the splitting of a sheet of homogenised tobacco material during production of the aerosol-generating element, as described above.

Preferably, the aerosol-generating element is in the form of one or more sheets of homogenised tobacco material. The one or more sheets of homogenised tobacco material may be produced by a casting process. The one or more sheets of homogenised tobacco material may be produced by a paper-making process. The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the aerosol-generating element is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 g/m2 and about 300 g/m2.

The one or more sheets as described herein may each individually have a density of from about 0.3 $g/cm^3$ to about 1.3 $g/cm^3$, and preferably from about 0.7 $g/cm^3$ to about 1.0 $g/cm^3$.

The one or more sheets of homogenised tobacco material sheets are preferably in the form of one or more gathered sheets. As used herein, the term "gathered" denotes that the sheet of homogenised tobacco material is convoluted, folded, or otherwise compressed or constricted substantially transversely to the cylindrical axis of a plug or a rod.

The one or more sheets of homogenised tobacco material may be gathered transversely relative to the longitudinal axis thereof and circumscribed with a wrapper to form a continuous rod or a plug.

The one or more sheets of homogenised tobacco material may advantageously be crimped or similarly treated. As used herein, the term "crimped" denotes a sheet having a plurality of substantially parallel ridges or corrugations. The one or more sheets of homogenised tobacco material may be embossed, debossed, perforated or otherwise deformed to provide texture on one or both sides of the sheet.

Preferably, each sheet of homogenised tobacco material may be crimped such that it has a plurality of ridges or corrugations substantially parallel to the cylindrical axis of the plug. This treatment advantageously facilitates gathering of the crimped sheet of homogenised tobacco material to form the plug. Preferably, the one or more sheets of homogenised tobacco material may be gathered. It will be appreciated that crimped sheets of homogenised tobacco material may have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised tobacco material.

The one or more sheets of homogenised tobacco material may be cut into strands as referred to above. The aerosol-generating substrate may comprise a plurality of strands of the homogenised tobacco material. The strands may be used to form a plug. Typically, the width of such strands is about 5 millimetres, or about 4 millimetres, or about 3 millimetres, or about 2 millimetres or less. The length of the strands may be greater than about 5 millimetres, between about 5 millimetres to about 15 millimetres, about 8 millimetres to about 12 millimetres, or about 12 millimetres. Preferably, the strands have substantially the same length as each other. The length of the strands may be determined by the manufacturing process whereby a rod is cut into shorter plugs and the length of the strands corresponds to the length of the plug. The strands may be fragile which may result in breakage especially during transit. In such cases, the length of some of the strands may be less than the length of the plug.

The plurality of strands preferably extend substantially longitudinally along the length of the aerosol-generating element, aligned with the longitudinal axis. Preferably, the plurality of strands are therefore aligned substantially parallel to each other.

The homogenised tobacco material may comprise up to about 95 percent by weight of plant particles, on a dry weight basis. Preferably, the homogenised tobacco material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised tobacco material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

Sheets of homogenised tobacco material for use in the present invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

With reference to the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. The tobacco particles may be substantially all derived from tobacco leaf lamina. By contrast, isolated nicotine and nicotine salts are compounds derived from tobacco but are not considered tobacco particles for purposes of the invention and are not included in the percentage of particulate plant material.

The tobacco particles may be prepared from one or more varieties of tobacco plants. Any type of tobacco may be used in a blend. Examples of tobacco types that may be used include, but are not limited to, sun-cured tobacco, flue-cured tobacco, Burley tobacco, Maryland tobacco, Oriental tobacco, Virginia tobacco, and other specialty tobaccos.

Flue-curing is a method of curing tobacco, which is particularly used with Virginia tobaccos. During the flue-curing process, heated air is circulated through densely packed tobacco. During a first stage, the tobacco leaves turn yellow and wilt. During a second stage, the laminae of the leaves are completely dried. During a third stage, the leaf stems are completely dried.

Burley tobacco plays a significant role in many tobacco blends. Burley tobacco has a distinctive flavour and aroma and also has an ability to absorb large amounts of casing.

Oriental is a type of tobacco which has small leaves, and high aromatic qualities. However, Oriental tobacco has a milder flavour than, for example, Burley. Generally, therefore, Oriental tobacco is used in relatively small proportions in tobacco blends.

Kasturi, Madura and Jatim are subtypes of sun-cured tobacco that can be used. Preferably, Kasturi tobacco and flue-cured tobacco may be used in a blend to produce the tobacco particles. Accordingly, the tobacco particles in the particulate plant material may comprise a blend of Kasturi tobacco and flue-cured tobacco.

The tobacco particles may have a nicotine content of at least about 2.5 percent by weight, based on dry weight. More preferably, the tobacco particles may have a nicotine content of at least about 3 percent, even more preferably at least about 3.2 percent, even more preferably at least about 3.5 percent, most preferably at least about 4 percent by weight, based on dry weight.

The aerosol-generating element may comprise a non-tobacco plant material. The homogenised tobacco material may comprise tobacco particles in combination with non-tobacco plant flavour particles. Preferably, the non-tobacco plant flavour particles are selected from one or more of: ginger particles, eucalyptus particles, clove particles and star anise particles. Preferably, the homogenised tobacco material comprises at least about 2.5 percent by weight of the non-tobacco plant flavour particles, on a dry weight basis, with the remainder of the plant particles being tobacco particles. Preferably, the homogenised tobacco material comprises at least about 4 percent by weight of non-tobacco plant flavour particles, more preferably at least about 6 percent by weight of non-tobacco plant flavour particles, more preferably at least about 8 percent by weight of non-tobacco plant flavour particles and more preferably at least about 10 percent by weight of non-tobacco plant flavour particles, on a dry weight basis. Preferably, the homogenised tobacco material comprises up to about 20 percent by weight of non-tobacco plant flavour particles, more preferably up to about 18 percent by weight of non-tobacco plant flavour particles, more preferably up to about 16 percent by weight of non-tobacco plant flavour particles.

The weight ratio of the non-tobacco plant flavour particles and the tobacco particles in the particulate plant material forming the homogenised tobacco material may vary depending on the desired flavour characteristics and composition of the aerosol produced from the aerosol-generating substrate during use. Preferably, the homogenised tobacco material comprises at least a 1:30 weight ratio of non-tobacco plant flavour particles to tobacco particles, more preferably at least a 1:20 weight ratio of non-tobacco plant flavour particles to tobacco particles, more preferably at least a 1:10 weight ratio of non-tobacco plant flavour particles to tobacco particles and most preferably at least a1:5 weight ratio of non-tobacco plant flavour particles to tobacco particles, on a dry weight basis.

The homogenised tobacco material preferably comprises no more than 95 percent by weight of the particulate plant material, on a dry weight basis. The particulate plant material is therefore typically combined with one or more other components to form the homogenised tobacco material.

The homogenised tobacco material may further comprise a binder to alter the mechanical properties of the particulate plant material, wherein the binder is included in the homogenised tobacco material during manufacturing as described herein. Suitable exogenous binders would be known to the skilled person and include but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof. Preferably, the binder comprises guar gum.

The binder may be present in an amount of from about 1 percent to about 10 percent by weight, based on the dry weight of the homogenised tobacco material, preferably in an amount of from about 2 percent to about 5 percent by weight, based on the dry weight of the homogenised tobacco material.

The homogenised tobacco material may further comprise one or more lipids to facilitate the diffusivity of volatile components (for example, aerosol formers, gingerols and nicotine), wherein the lipid is included in the homogenised tobacco material during manufacturing as described herein. Suitable lipids for inclusion in the homogenised tobacco material include, but are not limited to: medium-chain triglycerides, cocoa butter, palm oil, palm kernel oil, mango oil, shea butter, soybean oil, cottonseed oil, coconut oil, hydrogenated coconut oil, candellila wax, carnauba wax, shellac, sunflower wax, sunflower oil, rice bran, and Revel A; and combinations thereof.

The homogenised tobacco material may further comprise a pH modifier.

The homogenised tobacco material may further comprise fibres to alter the mechanical properties of the homogenised tobacco material, wherein the fibres are included in the homogenised tobacco material during manufacturing as described herein. Suitable exogenous fibres for inclusion in the homogenised tobacco material are known in the art and include fibres formed from non-tobacco material and non-ginger material, including but not limited to: cellulose fibres; soft-wood fibres; hard-wood fibres; jute fibres and combinations thereof. Exogenous fibres derived from tobacco and/or ginger can also be added. Any fibres added to the homogenised tobacco material are not considered to form part of the "particulate plant material" as defined above. Prior to inclusion in the homogenised tobacco material, fibres may be treated by suitable processes known in the art including, but not limited to: mechanical pulping; refining; chemical pulping; bleaching; sulfate pulping; and combinations thereof. A fibre typically has a length greater than its width.

Suitable fibres typically have lengths of greater than 400 micrometres and less than or equal to 4 millimetres, preferably within the range of 0.7 millimetres to 4 millimetres. Preferably, the fibres are present in an amount of about 2 percent to about 15 percent by weight, most preferably at about 4 percent by weight, based on the dry weight of the substrate.

In the context of the present invention, the aerosol-generating element further comprises one or more aerosol formers. Upon volatilisation, an aerosol former can convey other vaporised compounds released from the aerosol-generating element upon heating, such as nicotine and flavourants, in an aerosol. Suitable aerosol formers for inclusion in the aerosol-generating element are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-generating element may comprise two or more of homogenised tobacco material, tobacco cast leaf and reconstituted tobacco.

By way of example, the aerosol-generating element may comprise a sheet of homogenised tobacco material which is produced from a blend of high quality tobacco leaf material and wherein aerosol former is intimately combined with the tobacco leaf material prior to forming the sheet from the resulting mixture. One such homogenised tobacco material may be combined with a tobacco cast leaf or a reconstituted tobacco or both. The tobacco cast leaf or the reconstituted tobacco or both may for example be a standard cast leaf or standard reconstituted tobacco formed from tobacco particles, including but not limited to recovered tobacco particles, wherein the standard cast leaf or standard reconstituted tobacco is impregnated with aerosol former after being formed into a sheet.

The inventors have found that, when heated under the same conditions and for a same period of time, these tobacco materials may have different aerosol delivery profiles. In particular, a standard tobacco cast leaf may have a tendency to release aerosol species sooner and at lower temperatures compared with a standard reconstituted tobacco. In turn, a standard reconstituted tobacco may have a tendency to release aerosol species sooner and at lower temperatures compared with a homogenised tobacco material as described above. Thus, by adjusting the relative proportions of these different tobacco materials in the aerosol-generating element, it is advantageously possibly to fine tune the timing and intensity of aerosol delivery from the aerosol-generating element during use.

The aerosol-generating element may have an aerosol former content of between about 5 percent and about 30 percent by weight on a dry weight basis.

Preferably, the aerosol-generating element has an aerosol former content of at least about 10 percent by weight on a dry weight basis, more preferably at least about 15 percent by weight on a dry weight basis.

The aerosol-generating element has preferably an aerosol former content of less than or equal to about 25 percent by weight on a dry weight basis, more preferably less than or equal to about 20 percent by weight on a dry weight basis.

The aerosol-generating element may have an aerosol former content from 5 percent to 25 percent by weight on a dry weight basis, preferably from 10 percent to 25 percent by weight on a dry weight basis, more preferably from 15 percent to 25 percent by weight on a dry weight basis. The aerosol-generating element may have an aerosol former content from 5 percent to 20 percent by weight on a dry weight basis, preferably from 10 percent to 20 percent by weight on a dry weight basis, more preferably from 15 percent to 20 percent by weight on a dry weight basis.

The aerosol-generating element may have an aerosol former content of about 30 percent by weight to about 45 percent by weight. This relatively high level of aerosol former is particularly suitable for an aerosol-generating element that is intended to be heated at a temperature of less than 275 degrees Celsius. The aerosol-generating element preferably comprises a homogenised tobacco material comprising between about 2 percent by weight and about 10 percent by weight of cellulose ether, on a dry weight basis and between about 5 percent by weight and about 50 percent by weight of additional cellulose, on a dry weight basis. The use of the combination of cellulose ether and additional cellulose has been found to provide a particularly effective delivery of aerosol when used in an aerosol-generating substrate having an aerosol former content of between 30 percent by weight and 45 percent by weight.

Suitable cellulose ethers include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). The cellulose ether may be carboxymethyl cellulose.

As used herein, the term "additional cellulose" encompasses any cellulosic material incorporated into the homogenised tobacco material which does not derive from the non-tobacco plant particles or tobacco particles provided in the homogenised tobacco material. The additional cellulose is therefore incorporated in the homogenised tobacco material in addition to the non-tobacco plant material or tobacco material, as a separate and distinct source of cellulose to any cellulose intrinsically provided within the non-tobacco plant particles or tobacco particles. The additional cellulose will typically derive from a different plant to the non-tobacco plant particles or tobacco particles. Preferably, the additional cellulose is in the form of an inert cellulosic material, which is sensorially inert and therefore does not substantially impact the organoleptic characteristics of the aerosol generated from the aerosol-generating substrate. For example, the additional cellulose is preferably a tasteless and odourless material.

The additional cellulose may comprise cellulose powder, cellulose fibres, or a combination thereof.

The aerosol former may act as a humectant in the aerosol-generating element or substrate.

The aerosol-generating element may comprise a plug of a porous substrate.

The term "porous substrate" is used herein to describe a material that provides a plurality of pores or openings that allow the passage of air through the material. The porous substrate may be any suitable porous material able to hold or retain an aerosol-generating medium or flavour (flavourant), particularly if these are provided in liquid or gel form, as will be discussed below.

An advantage of a porous substrate loaded with an aerosol-generating medium or a flavour is that the aerosol-generating medium or flavour is retained within the porous medium, and this may aid manufacturing, storage or transport of the gel composition. This is especially effective when the aerosol-generating medium or flavour is in the form of a gel, as use of a porous substrate may assist in preserving the gel and maintaining the gel at the desired core location, especially during manufacture and transport, as well as during use.

The porous substrate may comprise natural materials, synthetic, or semi-synthetic, or a combination thereof. The porous substrate may comprise sheet material, foam, or fibres, for example loose fibres; or a combination thereof. The porous substrate may comprise a woven, non-woven, or extruded material, or combinations thereof. Preferably the porous substrate comprises, cotton, paper, viscose, PLA, or cellulose acetate, of combinations thereof. The porous substrate may comprise a gathered sheet material, for example, made of cotton or cellulose acetate.

The aerosol-generating medium may comprise a liquid or gel impregnating the porous substrate.

The aerosol-generating medium may comprise a gel comprising an alkaloid compound;

an aerosol former; and at least one gelling agent.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel may preferably include an alkaloid compound selected from the group consisting of nicotine, anatabine, and combinations thereof.

Preferably the gel includes nicotine.

The term "nicotine" refers to nicotine and nicotine derivatives such as free-base nicotine, nicotine salts and the like.

The gel preferably includes about 0.5 percent by weight to about 10 percent by weight of an alkaloid compound. The gel may include about 0.5 percent by weight to about 5 percent by weight of an alkaloid compound. Preferably the gel includes about 1 percent by weight to about 3 percent by weight of an alkaloid compound. The gel may preferably include about 1.5 percent by weight to about 2.5 percent by weight of an alkaloid compound. The gel may preferably include about 2 percent by weight of an alkaloid compound.

The alkaloid compound component of the gel may be the most volatile component of the gel. The gel may comprise water, and water may be the most volatile component of the gel and the alkaloid compound component of the gel may be the second most volatile component of the gel.

Preferably nicotine is included in the gel. The nicotine may be added to the gel composition in a free base form or a salt form.

The gel includes about 0.5 percent by weight to about 10 percent by weight nicotine, or about 0.5 percent by weight to about 5 percent by weight nicotine. Preferably the gel includes about 1 percent by weight to about 3 percent by weight nicotine, or about 1.5 percent by weight to about 2.5 percent by weight nicotine, or about 2 percent by weight nicotine.

As described briefly above, the gel preferably additionally includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1, 3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1, 3-butanediol and, glycerine (glycerol or propane-1,2,3-triol) or polyethylene glycol. The aerosol-former is preferably glycerol.

The gel may include a majority of an aerosol-former. The gel may include a mixture of water and the aerosol-former where the aerosol-former forms a majority (by weight) of the gel. The aerosol-former may form at least about 50 percent by weight of the gel. The aerosol-former may form at least about 60 percent by weight or at least about 65 percent by weight or at least about 70 percent by weight of the gel. The aerosol-former may form about 70 percent by weight to about 80 percent by weight of the gel. The aerosol-former may form about 70 percent by weight to about 75 percent by weight of the gel.

The gel may include a majority of glycerol. The gel may include a mixture of water and the glycerol where the glycerol forms a majority (by weight) of the gel. The glycerol may form at least about 50 percent by weight of the gel. The glycerol may form at least about 60 percent by weight or at least about 65 percent by weight or at least about 70 percent by weight of the gel. The glycerol may form about 70 percent by weight to about 80 percent by weight of the gel. The glycerol may form about 70 percent by weight to about 75 percent by weight of the gel.

The gel additionally preferably includes at least one gelling agent. Preferably, the gel composition includes a total amount of gelling agents in a range from about 0.4 percent by weight to about 10 percent by weight. More preferably, the gel includes the gelling agents in a range from about 0.5 percent by weight to about 8 percent by weight. More preferably, the gel includes the gelling agents in a range from about 1 percent by weight to about 6 percent by weight. More preferably, the gel includes the gelling agents in a range from about 2 percent by weight to about 4 percent by weight. More preferably, the gel includes the gelling agents in a range from about 2 percent by weight to about 3 percent by weight.

The term "gelling agent" refers to a compound that homogeneously, when added to a 50 percent by weight water/50 percent by weight glycerol mixture, in an amount of about 0.3 percent by weight, forms a solid medium or support matrix leading to a gel. Gelling agents include, but are not limited to, hydrogen-bond crosslinking gelling agents, and ionic crosslinking gelling agents.

The gelling agent may include one or more biopolymers. The biopolymers may be formed of polysaccharides.

Biopolymers include, for example, gellan gums (native, low acyl gellan gum, high acyl gellan gums with low acyl gellan gum being preferred), xanthan gum, alginates (alginic acid), agar, guar gum, and the like. The composition may preferably include xanthan gum. The composition may include two biopolymers. The composition may include three biopolymers. The composition may include the two biopolymers in substantially equal weights. The composition may include the three biopolymers in substantially equal weights.

Preferably, the gel comprises at least about 0.2 percent by weight hydrogen-bond crosslinking gelling agent. The gel preferably comprises at least about 0.2 percent by weight ionic crosslinking gelling agent. Most preferably, the gel comprises at least about 0.2 percent by weight hydrogen-bond crosslinking gelling agent and at least about 0.2 percent by weight ionic crosslinking gelling agent. The gel may comprise about 0.5 percent by weight to about 3 percent by weight hydrogen-bond crosslinking gelling agent and about 0.5 percent by weight to about 3 percent by weight ionic crosslinking gelling agent, or about 1 percent by weight to about 2 percent by weight hydrogen-bond crosslinking gelling agent and about 1 percent by weight to about 2 percent by weight ionic crosslinking gelling agent. The hydrogen-bond crosslinking gelling agent and ionic crosslinking gelling agent may be present in the gel in substantially equal amounts by weight.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as an N, O, or F atom and another very electronegative atom.

The hydrogen-bond crosslinking gelling agent may include one or more of a galactomannan, gelatin, agarose, or konjac gum, or agar. The hydrogen-bond crosslinking gelling agent may preferably include agar.

The gel preferably includes the hydrogen-bond crosslinking gelling agent in a range from about 0.3 percent by weight to about 5 percent by weight. Preferably the gel includes the hydrogen-bond crosslinking gelling agent in a range from about 0.5 percent by weight to about 3 percent by weight. Preferably the gel includes the hydrogen-bond crosslinking gelling agent in a range from about 1 percent by weight to about 2 percent by weight.

The gel may include a galactomannan in a range from about 0.2 percent by weight to about 5 percent by weight. Preferably the galactomannan may be in a range from about 0.5 percent by weight to about 3 percent by weight. Preferably the galactomannan may be in a range from about 0.5 percent by weight to about 2 percent by weight. Preferably the galactomannan may be in a range from about 1 percent by weight to about 2 percent by weight.

The gel may include a gelatin in a range from about 0.2 percent by weight to about 5 percent by weight. Preferably the gelatin may be in a range from about 0.5 percent by weight to about 3 percent by weight. Preferably the gelatin may be in a range from about 0.5 percent by weight to about 2 percent by weight. Preferably the gelatin may be in a range from about 1 percent by weight to about 2 percent by weight.

The gel may include agarose in a range from about 0.2 percent by weight to about 5 percent by weight. Preferably the agarose may be in a range from about 0.5 percent by weight to about 3 percent by weight. Preferably the agarose may be in a range from about 0.5 percent by weight to about 2 percent by weight. Preferably the agarose may be in a range from about 1 percent by weight to about 2 percent by weight.

The gel may include konjac gum in a range from about 0.2 percent by weight to about 5 percent by weight. Preferably the konjac gum may be in a range from about 0.5 percent by weight to about 3 percent by weight. Preferably the konjac gum may be in a range from about 0.5 percent by weight to about 2 percent by weight. Preferably the konjac gum may be in a range from about 1 percent by weight to about 2 percent by weight.

The gel may include agar in a range from about 0.2 percent by weight to about 5 percent by weight. Preferably the agar may be in a range from about 0.5 percent by weight to about 3 percent by weight. Preferably the agar may be in a range from about 0.5 percent by weight to about 2 percent by weight. Preferably the agar may be in a range from about 1 percent by weight to about 2 percent by weight.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The ionic crosslinking gelling agent may include low acyl gellan, pectin, kappa carrageenan, iota carrageenan or alginate. The ionic crosslinking gelling agent may preferably include low acyl gellan.

The gel may include the ionic crosslinking gelling agent in a range from about 0.3 percent by weight to about 5 percent by weight. Preferably the gel includes the ionic crosslinking gelling agent in a range from about 0.5 percent by weight to about 3 percent by weight by weight. Preferably the gel includes the ionic crosslinking gelling agent in a range from about 1 percent by weight to about 2 percent by weight.

The gel may include low acyl gellan in a range from about 0.2 percent by weight to about 5 percent by weight. Preferably the low acyl gellan may be in a range from about 0.5 percent by weight to about 3 percent by weight. Preferably the low acyl gellan may be in a range from about 0.5 percent by weight to about 2 percent by weight. Preferably the low acyl gellan may be in a range from about 1 percent by weight to about 2 percent by weight.

The gel may include pectin in a range from about 0.2 percent by weight to about 5 percent by weight. Preferably the pectin may be in a range from about 0.5 percent by weight to about 3 percent by weight. Preferably the pectin may be in a range from about 0.5 percent by weight to about 2 percent by weight. Preferably the pectin may be in a range from about 1 percent by weight to about 2 percent by weight.

The gel may include kappa carrageenan in a range from about 0.2 percent by weight to about 5 percent by weight. Preferably the kappa carrageenan may be in a range from about 0.5 percent by weight to about 3 percent by weight. Preferably the kappa carrageenan may be in a range from about 0.5 percent by weight to about 2 percent by weight. Preferably the kappa carrageenan may be in a range from about 1 percent by weight to about 2 percent by weight.

The gel may include iota carrageenan in a range from about 0.2 percent by weight to about 5 percent by weight. Preferably the iota carrageenan may be in a range from about 0.5 percent by weight to about 3 percent by weight. Preferably the iota carrageenan may be in a range from about 0.5 percent by weight to about 2 percent by weight. Preferably the iota carrageenan may be in a range from about 1 percent by weight to about 2 percent by weight.

The gel may include alginate in a range from about 0.2 percent by weight to about 5 percent by weight. Preferably the alginate may be in a range from about 0.5 percent by weight to about 3 percent by weight. Preferably the alginate may be in a range from about 0.5 percent by weight to about 2 percent by weight. Preferably the alginate may be in a range from about 1 percent by weight to about 2 percent by weight.

The gel may include the hydrogen-bond crosslinking gelling agent and ionic crosslinking gelling agent in a ratio of about 3:1 to about 1:3. Preferably the gel may include the hydrogen-bond crosslinking gelling agent and ionic crosslinking gelling agent in a ratio of about 2:1 to about 1:2. Preferably the gel may include the hydrogen-bond crosslinking gelling agent and ionic crosslinking gelling agent in a ratio of about 1:1.

The gel may further include a viscosifying agent. The viscosifying agent combined with the hydrogen-bond crosslinking gelling agent and the ionic crosslinking gelling agent appears to surprisingly support the solid medium and maintain the gel composition even when the gel composition comprises a high level of glycerol.

The term "viscosifying agent" refers to a compound that, when added homogeneously into a 25° C., 50 percent by weight water/50 percent by weight glycerol mixture, in an amount of 0.3 percent by weight, increases the viscosity without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity to at least 50 cPs, preferably at least 200 cPs, preferably at least 500 cPs, preferably at least 1000 cPs at a shear rate of 0.1 $s^{-1}$, without leading to the formation of a gel, the mixture staying or remaining fluid.

Preferably the viscosifying agent refers to a compound that when added homogeneously into a 25° C. 50 percent by weight water/50 percent by weight glycerol mixture, in an amount of 0.3 percent by weight, increases the viscosity at least 2 times, or at least 5 times, or at least 10 times, or at least 100 times higher than before addition, at a shear rate of 0.1 $s^{-1}$, without leading to the formation of a gel, the mixture staying or remaining fluid.

The viscosity values recited herein can be measured using a Brookfield RVT viscometer rotating a disc type RV #2 spindle at 25° C. at a speed of 6 revolutions per minute (rpm).

The gel preferably includes the viscosifying agent in a range from about 0.2 percent by weight to about 5 percent by weight. Preferably the gel includes the viscosifying agent in a range from about 0.5 percent by weight to about 3 percent by weight. Preferably the gel includes the viscosifying agent in a range from about 0.5 percent by weight to about 2 percent by weight. Preferably the gel includes the viscosifying agent in a range from about 1 percent by weight to about 2 percent by weight.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel may include xanthan gum in a range from about 0.2 percent by weight to about 5 percent by weight. Preferably the xanthan gum may be in a range from about 0.5 percent by weight to about 3 percent by weight. Preferably the xanthan gum may be in a range from about 0.5 percent by weight to about 2 percent by weight. Preferably the xanthan gum may be in a range from about 1 percent by weight to about 2 percent by weight.

The gel may include carboxymethyl-cellulose in a range from about 0.2 percent by weight to about 5 percent by weight. Preferably the carboxymethyl-cellulose may be in a range from about 0.5 percent by weight to about 3 percent by weight. Preferably the carboxymethyl-cellulose may be in a range from about 0.5 percent by weight to about 2 percent by weight. Preferably the carboxymethyl-cellulose may be in a range from about 1 percent by weight to about 2 percent by weight.

The gel may include microcrystalline cellulose in a range from about 0.2 percent by weight to about 5 percent by weight. Preferably the microcrystalline cellulose may be in a range from about 0.5 percent by weight to about 3 percent by weight. Preferably the microcrystalline cellulose may be in a range from about 0.5 percent by weight to about 2 percent by weight. Preferably the microcrystalline cellulose may be in a range from about 1 percent by weight to about 2 percent by weight.

The gel may include methyl cellulose in a range from about 0.2 percent by weight to about 5 percent by weight. Preferably the methyl cellulose may be in a range from about 0.5 percent by weight to about 3 percent by weight. Preferably the methyl cellulose may be in a range from about 0.5 percent by weight to about 2 percent by weight. Preferably the methyl cellulose may be in a range from about 1 percent by weight to about 2 percent by weight.

The gel may include gum Arabic in a range from about 0.2 percent by weight to about 5 percent by weight. Preferably the gum Arabic may be in a range from about 0.5 percent by weight to about 3 percent by weight. Preferably the gum Arabic may be in a range from about 0.5 percent by weight to about 2 percent by weight. Preferably the gum Arabic may be in a range from about 1 percent by weight to about 2 percent by weight.

The gel may include guar gum in a range from about 0.2 percent by weight to about 5 percent by weight. Preferably the guar gum may be in a range from about 0.5 percent by weight to about 3 percent by weight. Preferably the guar gum may be in a range from about 0.5 percent by weight to about 2 percent by weight. Preferably the guar gum may be in a range from about 1 percent by weight to about 2 percent by weight.

The gel may include lambda carrageenan in a range from about 0.2 percent by weight to about 5 percent by weight. Preferably the lambda carrageenan may be in a range from about 0.5 percent by weight to about 3 percent by weight. Preferably the lambda carrageenan may be in a range from about 0.5 percent by weight to about 2 percent by weight. Preferably the lambda carrageenan may be in a range from about 1 percent by weight to about 2 percent by weight.

The gel may include starch in a range from about 0.2 percent by weight to about 5 percent by weight. Preferably the starch may be in a range from about 0.5 percent by weight to about 3 percent by weight. Preferably the starch may be in a range from about 0.5 percent by weight to about 2 percent by weight. Preferably the starch may be in a range from about 1 percent by weight to about 2 percent by weight.

The gel may further include a divalent cation. Preferably the divalent cation includes calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1 percent by weight, or about 0.5 percent by weight to about 1 percent by weight.

The gel may further include an acid. The acid may comprise a carboxylic acid. The carboxylic acid may include a ketone group. Preferably the carboxylic acid may include a ketone group having less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel even over similar carboxylic acids. The carboxylic acid may assist in the gel formation. The carboxylic acid may reduce variation of the alkaloid compound concentration within the gel during storage. The carboxylic acid may reduce variation of the nicotine concentration within the gel during storage.

The gel may include a carboxylic acid in a range from about 0.1 percent by weight to about 5 percent by weight. Preferably the carboxylic acid may be in a range from about 0.5 percent by weight to about 3 percent by weight. Preferably the carboxylic acid may be in a range from about 0.5 percent by weight to about 2 percent by weight. Preferably the carboxylic acid may be in a range from about 1 percent by weight to about 2 percent by weight.

The gel may include lactic acid in a range from about 0.1 percent by weight to about 5 percent by weight. Preferably the lactic acid may be in a range from about 0.5 percent by weight to about 3 percent by weight. Preferably the lactic acid may be in a range from about 0.5 percent by weight to about 2 percent by weight. Preferably the lactic acid may be in a range from about 1 percent by weight to about 2 percent by weight.

The gel may include levulinic acid in a range from about 0.1 percent by weight to about 5 percent by weight. Preferably the levulinic acid may be in a range from about 0.5 percent by weight to about 3 percent by weight. Preferably the levulinic acid may be in a range from about 0.5 percent by weight to about 2 percent by weight. Preferably the levulinic acid may be in a range from about 1 percent by weight to about 2 percent by weight.

The gel preferably comprises some water. The gel is more stable when the gel comprises some water. Preferably the gel comprises at least about 1 percent by weight, or at least about 2 percent by weight, or at least about 5 percent by weight of water. Preferably the gel comprises at least about 10 percent by weight or at least about 15 percent by weight water.

Preferably the gel comprises between about 8 percent by weight to about 32 percent by weight water. Preferably the gel comprises from about 15 percent by weight to about 25 percent by weight water. Preferably the gel comprises from about 18 percent by weight to about 22 percent by weight water. Preferably the gel comprises about 20 percent by weight water.

An aerosol-generating article in accordance with the present invention comprises an aerosol-generating rod as described above, and may additionally comprise a downstream section at a location downstream of the aerosol-generating rod, which as described above comprises or consists of the first plug segment, the aerosol-generating element and the second plug segment. An aerosol-generating article in accordance with the present invention may comprise an upstream section at a location upstream of the aerosol-generating rod.

The downstream section may comprise one or more downstream elements.

The downstream section may comprise a support element arranged in alignment with, and downstream of the aerosol-generating rod. In particular, the support element may be located immediately downstream of the aerosol-generating rod and may abut the aerosol-generating rod.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). The support element may be formed from cellulose acetate. Other suitable materials include polyhydroxyalkanoate (PHA) fibres.

The support element may comprise a hollow tubular segment. The support element may comprise a hollow cellulose acetate tube.

The support element may be arranged substantially in alignment with the aerosol-generating rod. This means that the length dimension of the support element is arranged to be approximately parallel to the longitudinal direction of the rod and of the article, for example within plus or minus 10 degrees of parallel to the longitudinal direction of the rod. The support element may extend along the longitudinal axis of the rod.

The support element preferably has an outer diameter that is approximately equal to the outer diameter of the aerosol-generating rod.

A peripheral wall of the support element may have a thickness of at least 1 millimetre, preferably at least about 1.5 millimetres, more preferably at least about 2 millimetres.

The support element may have a length of between about 5 millimetres and about 15 millimetres. Preferably, the support element has a length of at least about 6 millimetres, more preferably at least about 7 millimetres. The support element may have a length of less than about 12 millimetres, more preferably less than about 10 millimetres.

The support element may have a length from about 5 millimetres to about 15 millimetres, preferably from about 6 millimetres to about 15 millimetres, more preferably from about 7 millimetres to about 15 millimetres. The support element may have a length from about 5 millimetres to about 12 millimetres, preferably from about 6 millimetres to about 12 millimetres, more preferably from about 7 millimetres to about 12 millimetres. The support element may have a length from about 5 millimetres to about 10 millimetres, preferably from about 6 millimetres to about 10 millimetres, more preferably from about 7 millimetres to about 10 millimetres. The support element may have a length of about 8 millimetres.

Preferably, the hollow tubular segment of the support element is adapted to generate a RTD between approximately 0 millimetres $H_2O$ (about 0 Pa) to approximately 20 millimetres $H_2O$ (about 100 Pa), more preferably between approximately 0 millimetres $H_2O$ (about 0 Pa) to approximately 10 millimetres $H_2O$ (about 100 Pa). The support element therefore preferably does not contribute to the overall RTD of the aerosol-generating article.

The downstream section of the aerosol-generating article may comprise a mouthpiece element positioned downstream of the aerosol-generating rod and in longitudinal alignment with the aerosol-generating rod.

The mouthpiece element is preferably located at the downstream end or mouth end of the aerosol-generating article, and extends all the way to the mouth end of the aerosol-generating article.

Preferably, the mouthpiece element comprises at least one mouthpiece filter segment of a fibrous filtration material for filtering the aerosol that is generated from the aerosol-generating substrate. Suitable fibrous filtration materials would be known to the skilled person. Particularly preferably, the at least one mouthpiece filter segment comprises a cellulose acetate filter segment formed of cellulose acetate tow.

The mouthpiece element may consist of a single mouthpiece filter segment. The mouthpiece element may include two or more mouthpiece filter segments axially aligned in an abutting end to end relationship with each other.

The downstream section may comprise a mouth end cavity at the downstream end, downstream of the mouthpiece element as described above. The mouth end cavity may be defined by a hollow tubular element provided at the downstream end of the mouthpiece. The mouth end cavity may be defined by the outer wrapper of the mouthpiece element, wherein the outer wrapper extends in a downstream direction from the mouthpiece element.

The mouthpiece element may optionally comprise a flavourant, which may be provided in any suitable form. For example, the mouthpiece element may comprise one or more capsules, beads or granules of a flavourant, or one or more flavour loaded threads or filaments.

The downstream section of the aerosol-generating article may further comprise both a support element located immediately downstream of the aerosol-generating rod and a mouthpiece element located downstream of the support element.

Preferably, the mouthpiece element has a low particulate filtration efficiency.

Preferably, the mouthpiece is formed of a segment of a fibrous filtration material.

Preferably, the mouthpiece element is circumscribed by a plug wrap. Preferably, the mouthpiece element is unventilated such that air does not enter the aerosol-generating article along the mouthpiece element.

The mouthpiece element is preferably connected to one or more of the adjacent upstream components of the aerosol-generating article by means of a tipping wrapper.

Preferably, the mouthpiece element has an RTD of less than about 25 millimetres $H_2O$. More preferably, the mouthpiece element has an RTD of less than about 20 millimetres $H_2O$. Even more preferably, the mouthpiece element has an RTD of less than about 15 millimetres $H_2O$.

Values of RTD from about 10 millimetres $H_2O$ to about to about 15 millimetres $H_2O$ are particularly preferred because a mouthpiece element having one such RTD is expected to contribute minimally to the overall RTD of the aerosol-generating article substantially does not exert a filtration action on the aerosol being delivered to the user.

The mouthpiece element preferably has an external diameter that is approximately equal to the external diameter of the aerosol-generating article.

The mouthpiece element preferably has a length of at least about 5 millimetres, more preferably at least about 8 millimetres, more preferably at least about 10 millimetres. The mouthpiece element preferably has a length of less than about 25 millimetres, more preferably less than about 20 millimetres, more preferably less than about 15 millimetres.

The mouthpiece element preferably has a length from about 5 millimetres to about 25 millimetres, more preferably from about 8 millimetres to about 25 millimetres, even more preferably from about 10 millimetres to about 25 millimetres. The mouthpiece element preferably has a length from about 5 millimetres to about 10 millimetres, more preferably from about 8 millimetres to about 20 millimetres, even more preferably from about 10 millimetres to about 20 millimetres. The mouthpiece element preferably has a length from about 5 millimetres to about 15 millimetres, more preferably from about 8 millimetres to about 15 millimetres, even more preferably from about 10 millimetres to about 15 millimetres.

For example, the mouthpiece element may have a length of between about 5 millimetres and about 25 millimetres, or between about 8 millimetres and about 20 millimetres, or between about 10 millimetres and about 15 millimetres. The mouthpiece element may have a length of approximately 12 millimetres.

The downstream section may further comprise an aerosol-cooling element located downstream of the support element, with the mouthpiece element located downstream of both the support element and the aerosol-cooling element. Particularly preferably, the mouthpiece element is located immediately downstream of the aerosol-cooling element. By way of example, the mouthpiece element may abut the downstream end of the aerosol-cooling element.

The aerosol-cooling element may for example define a plurality of longitudinally extending channels such as to make a high surface area available for heat exchange. The plurality of longitudinally extending channels may be defined by a sheet material that has been pleated, gathered or folded to form the channels. The plurality of longitudinally extending channels may be defined by a single sheet that has been pleated, gathered or folded to form multiple channels. The sheet may also have been crimped prior to being pleated, gathered or folded. The plurality of longitudinally extending channels may be defined by multiple sheets that have been crimped, pleated, gathered or folded to form multiple channels. The plurality of longitudinally extending channels may be defined by multiple sheets that have been crimped, pleated, gathered or folded together—that is by two or more sheets that have been brought into overlying arrangement and then crimped, pleated, gathered or folded as one.

One such aerosol-cooling element may have a total surface area of between about 300 square millimetre per millimetre length and about 1000 square millimetres per millimetre length. One such aerosol-cooling element preferably offers a low resistance to the passage of air through additional cooling element. Preferably, the aerosol-cooling element does not substantially affect the resistance to draw of the aerosol-generating article. The aerosol-cooling element preferably comprises a sheet material selected from the group comprising a metallic foil, a polymeric sheet, and a substantially non-porous paper or cardboard. The aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil. The additional cooling element comprises a sheet of PLA.

The aerosol-generating article may further comprise an upstream section at a location upstream of the aerosol-generating element. The upstream section may comprise one or more upstream elements. The upstream section may comprise an upstream element arranged immediately upstream of the aerosol-generating element.

The upstream element may provide an improved appearance to the upstream end of the aerosol-generating article. Furthermore, if desired, the upstream element may be used to provide information on the aerosol-generating article, such as information on brand, flavour, content, or details of the aerosol-generating device that the article is intended to be used with.

The upstream element may be a porous plug element. Preferably, a porous plug element does not alter the resistance to draw of the aerosol-generating article. Preferably, the upstream element has a porosity of at least about 50 percent in the longitudinal direction of the aerosol-generating article. More preferably, the upstream element has a porosity of between about 50 percent and about 90 percent in the longitudinal direction. The porosity of the upstream element in the longitudinal direction is defined by the ratio of the cross-sectional area of material forming the upstream element and the internal cross-sectional area of the aerosol-generating article at the position of the upstream element.

The upstream element may be made of a porous material or may comprise a plurality of openings. This may, for example, be achieved through laser perforation. Preferably, the plurality of openings is distributed homogeneously over the cross-section of the upstream element.

The porosity or permeability of the upstream element may advantageously be varied in order to provide a desirable overall resistance to draw of the aerosol-generating article.

Preferably, the RTD of the upstream element is at least about 5 millimetres $H_2O$. More preferably, the RTD of the upstream element is at least about 10 millimetres $H_2O$. Even more preferably, the RTD of the upstream element is at least about 15 millimetres $H_2O$. The RTD of the upstream element may be at least about 20 millimetres $H_2O$.

The RTD of the upstream element is preferably less than or equal to about 80 millimetres $H_2O$. More preferably, the RTD of the upstream element is less than or equal to about 60 millimetres $H_2O$. Even more preferably, the RTD of the upstream element is less than or equal to about 40 millimetres $H_2O$.

The RTD of the upstream element may be from about 5 millimetres $H_2O$ to about 80 millimetres $H_2O$, preferably from about 10 millimetres $H_2O$ to about 80 millimetres $H_2O$, more preferably from about 15 millimetres $H_2O$ to about 80 millimetres $H_2O$, even more preferably from about 20 millimetres $H_2O$ to about 80 millimetres $H_2O$. The RTD of the upstream element may be from about 5 millimetres $H_2O$ to about 60 millimetres $H_2O$, preferably from about 10 millimetres $H_2O$ to about 60 millimetres $H_2O$, more preferably from about 15 millimetres $H_2O$ to about 60 millimetres $H_2O$, even more preferably from about 20 millimetres $H_2O$ to about 60 millimetres $H_2O$. The RTD of the upstream element may be from about 5 millimetres $H_2O$ to about 40 millimetres $H_2O$, preferably from about 10 millimetres $H_2O$ to about 40 millimetres $H_2O$, more preferably from about 15 millimetres $H_2O$ to about 40 millimetres $H_2O$, even more preferably from about 20 millimetres $H_2O$ to about 40 millimetres $H_2O$.

The upstream element may be formed from a material that is impermeable to air. The aerosol-generating article may be configured such that air flows into the aerosol-generating rod through suitable ventilation means provided in a wrapper.

The upstream element may be made of any material suitable for use in an aerosol-generating article. The upstream element may, for example, be made of a same material as used for one of the other components of the aerosol-generating article, such as the mouthpiece, the cooling element or the support element. Suitable materials for forming the upstream element include filter materials, ceramic, polymer material, cellulose acetate, cardboard, zeolite or aerosol-generating substrate. Preferably, the upstream element is formed from a plug of cellulose acetate.

Preferably, the upstream element is formed of a heat resistant material. For example, preferably the upstream element is formed of a material that resists temperatures of up to 350 degrees Celsius. This ensures that the upstream element is not adversely affected by the heating means for heating the aerosol-generating substrate.

Preferably, the upstream element has a diameter that is approximately equal to the diameter of the aerosol-generating article.

Preferably, the upstream element has a length of between about 1 millimetre and about 10 millimetres, more preferably between about 3 millimetres and about 8 millimetres, more preferably between about 4 millimetres and about 6 millimetres. The upstream element may have a length of about 5 millimetres. The length of the upstream element can advantageously be varied in order to provide the desired total length of the aerosol-generating article. For example, where it is desired to reduce the length of one of the other components of the aerosol-generating article, the length of the upstream element may be increased in order to maintain the same overall length of the article.

The upstream element preferably has a substantially homogeneous structure. For example, the upstream element may be substantially homogeneous in texture and appearance. The upstream element may, for example, have a continuous, regular surface over its entire cross section. The upstream element may, for example, have no recognisable symmetries.

The upstream element is preferably circumscribed by a wrapper. The wrapper circumscribing the upstream element is preferably a stiff plug wrap, for example, a plug wrap having a basis weight of at least about 80 grams per square metre (gsm), or at least about 100 gsm, or at least about 110 gsm. This provides structural rigidity to the upstream element.

The aerosol-generating article may have a length from about 35 millimetres to about 100 millimetres.

The aerosol-generating article may have a length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres. Even more preferably, an overall length of an aerosol-generating article in accordance with the invention is preferably less than or equal to 50 millimetres.

An overall length of the aerosol-generating article is preferably from about 38 millimetres to about 70 millimetres, more preferably from about 40 millimetres to about 70 millimetres, even more preferably from about 42 millimetres to about 70 millimetres. An overall length of the aerosol-generating article is preferably from about 38 millimetres to about 60 millimetres, more preferably from about 40 millimetres to about 60 millimetres, even more preferably from about 42 millimetres to about 60 millimetres. An overall length of the aerosol-generating article is preferably from about 38 millimetres to about 50 millimetres, more preferably from about 40 millimetres to about 50 millimetres, even more preferably from about 42 millimetres to about 50 millimetres. An overall length of the aerosol-generating article may be about 45 millimetres.

The aerosol-generating article has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

The aerosol-generating article may have an external diameter from about 5 millimetres to about 12 millimetres, preferably from about 6 millimetres to about 12 millimetres, more preferably from about 7 millimetres to about 12 millimetres. The aerosol-generating article may have an external diameter from about 5 millimetres to about 10 millimetres, preferably from about 6 millimetres to about 10 millimetres, more preferably from about 7 millimetres to about 10 millimetres. The aerosol-generating article may have an external diameter from about 5 millimetres to about 8 millimetres, preferably from about 6 millimetres to about 8 millimetres, more preferably from about 7 millimetres to about 8 millimetres.

An aerosol-generating article in accordance with the present invention comprises, in linear sequential arrangement, an upstream element, an aerosol-generating rod located immediately downstream of the upstream element, a support element located immediately downstream of the aerosol-generating element, a mouthpiece element located immediately downstream of the support element, and an outer wrapper circumscribing the upstream element, the aerosol-generating element, the support element, and the mouthpiece element.

In more detail, the aerosol-generating rod may abut the upstream element. The support element may abut the aerosol-generating rod. The aerosol-cooling element may abut the support element. The mouthpiece element may abut the aerosol-cooling element.

The aerosol-generating article has a substantially cylindrical shape and an outer diameter of about 7.25 millimetres.

The upstream element has a length of about 9 millimetres, the aerosol-generating element has a length of about 12 millimetres, the support element has a length of about 18 millimetres, and the mouthpiece element has a length of about 8 millimetres. Thus, an overall length of the aerosol-generating article is about 47 millimetres.

The upstream element is in the form of a plug of cellulose acetate wrapped in stiff plug wrap.

The aerosol-generating rod comprises, in linear sequential arrangement, a second aerosol-generating segment comprising a plug of porous substrate and an aerosol-generating gel as described above provided in a core portion of the plug; a first aerosol-generating segment comprising a gathered sheet of homogenised tobacco material; and a non-aerosol-generating segment comprising a plug of porous substrate.

The mouthpiece is in the form of a low-density cellulose acetate filter segment.

Aerosol-generating rods and articles in accordance with the present invention may be used in an aerosol-generating device comprising a heater for heating a rod or article. Thus, the invention also relates to an aerosol-generating system comprising one such aerosol-generating device, such as an electrically heated aerosol-generating device, and an aerosol-generating article including an aerosol-generating rod as described above. Examples of suitable aerosol-generating devices will be known to the person of skill in the art. In general, suitable aerosol-generating devices will comprise a heating chamber for receiving at least one aerosol-generating article, and a heater adapted to heat the at least one aerosol-generating article when they are received within the chamber.

This includes, but is not limited to, aerosol-generating devices including one or more induction heaters arranged about the periphery of a susceptor tubular element defining the heating chamber. Aerosol-generating devices comprising other types of external heater elements may also be suitable.

Preferably, the aerosol-generating article comprises a susceptor element. The susceptor element may be located within the aerosol-generating element or may circumscribe the aerosol-generating element.

As discussed above, the present disclosure also relates to an aerosol-generating system comprising an aerosol-generating device having a distal end and a mouth end. The aerosol-generating device comprises a body. The body or housing of the aerosol-generating device defines a device cavity for removably receiving the aerosol-generating article at the mouth end of the device. The aerosol-generating device comprises a heating element or heater for heating the aerosol-generating substrate when the aerosol-generating article is received within the device cavity.

The device cavity may be referred to as the heating chamber of the aerosol-generating device. The device cavity may extend between a distal end and a mouth, or proximal, end. The distal end of the device cavity may be a closed end and the mouth, or proximal, end of the device cavity may be an open end. An aerosol-generating article may be inserted into the device cavity, or heating chamber, via the open end of the device cavity. The device cavity may be cylindrical in shape so as to conform to the same shape of an aerosol-generating article.

The expression "received within" may refer to the fact that a component or element is fully or partially received within another component or element. For example, the expression "aerosol-generating article is received within the device cavity" refers to the aerosol-generating article being fully or partially received within the device cavity of the aerosol-generating article. When the aerosol-generating article is received within the device cavity, the aerosol-generating article may abut the distal end of the device cavity. When the aerosol-generating article is received within the device cavity, the aerosol-generating article may be in substantial proximity to the distal end of the device cavity. The distal end of the device cavity may be defined by an end-wall.

A diameter of the device cavity may be the same as or greater than a diameter of the aerosol-generating article. A diameter of the device cavity may be the same as a diameter of the aerosol-generating article in order to establish a tight fit with the aerosol-generating article.

The device cavity may be configured to establish a tight fit with an aerosol-generating article received within the device cavity. Tight fit may refer to a snug fit. The aerosol-generating device may comprise a peripheral wall. Such a peripheral wall may define the device cavity, or heating chamber. The peripheral wall defining the device cavity may be configured to engage with an aerosol-generating article received within the device cavity in a tight fit manner, so that there is substantially no gap or empty space between the peripheral wall defining the device cavity and the aerosol-generating article when received within the device.

Such a tight fit may establish an airtight fit or configuration between the device cavity and an aerosol-generating article received therein.

With such an airtight configuration, there would be substantially no gap or empty space between the peripheral wall defining the device cavity and the aerosol-generating article for air to flow through.

The tight fit with an aerosol-generating article may be established along the entire length of the device cavity or along a portion of the length of the device cavity.

The aerosol-generating device may comprise an air-flow channel extending between a channel inlet and a channel outlet. The air-flow channel may be configured to establish a fluid communication between the interior of the device cavity and the exterior of the aerosol-generating device. The air-flow channel of the aerosol-generating device may be defined within the housing of the aerosol-generating device to enable fluid communication between the interior of the device cavity and the exterior of the aerosol-generating device. When an aerosol-generating article is received within the device cavity, the air-flow channel may be configured to provide air flow into the article in order to deliver generated aerosol to a user drawing from the mouth end of the article.

The air-flow channel of the aerosol-generating device may be defined within, or by, the peripheral wall of the housing of the aerosol-generating device. In other words, the air-flow channel of the aerosol-generating device may be defined within the thickness of the peripheral wall or by the inner surface of the peripheral wall, or a combination of both. The air-flow channel may partially be defined by the inner surface of the peripheral wall and may be partially defined within the thickness of the peripheral wall. The inner surface of the peripheral wall defines a peripheral boundary of the device cavity.

The air-flow channel of the aerosol-generating device may extend from an inlet located at the mouth end, or proximal end, of the aerosol-generating device to an outlet located away from mouth end of the device. The air-flow channel may extend along a direction parallel to the longitudinal axis of the aerosol-generating device.

The aerosol-generating device may comprise an elongate heater (or heating element) arranged for insertion into an aerosol-generating article when an aerosol-generating article is received within the device cavity. The elongate heater may be arranged with the device cavity. The elongate heater may extend into the device cavity. Further heating arrangements are discussed further below.

The heater may be any suitable type of heater. Preferably, the heater is an external heater.

Preferably, the heater may externally heat the aerosol-generating article when received within the aerosol-generating device. Such an external heater may circumscribe the aerosol-generating article when inserted in or received within the aerosol-generating device.

The heater may be arranged to heat the outer surface of the aerosol-forming substrate. The heater may be arranged for insertion into an aerosol-forming substrate when the aerosol-forming substrate is received within the cavity. The heater may be positioned within the device cavity, or heating chamber.

The heater may comprise at least one heating element. The at least one heating element may be any suitable type of heating element. The device may comprise only one heating element. The device may comprise a plurality of heating elements. The heater may comprise at least one resistive heating element. Preferably, the heater comprises a plurality of resistive heating elements. Preferably, the resistive heating elements are electrically connected in a parallel arrangement. Advantageously, providing a plurality of resistive heating elements electrically connected in a parallel arrangement may facilitate the delivery of a desired electrical power to the heater while reducing or minimising the voltage required to provide the desired electrical power. Advantageously, reducing or minimising the voltage required to operate the heater may facilitate reducing or minimising the physical size of the power supply.

Suitable materials for forming the at least one resistive heating element include but are not limited to: semiconductors such as doped ceramics, electrically 'conductive' ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

The at least one resistive heating element may comprise one or more stamped portions of electrically resistive material, such as stainless steel. The at least one resistive heating element may comprise a heating wire or filament, for example a Ni—Cr (Nickel-Chromium), platinum, tungsten or alloy wire.

The at least one heating element may comprise an electrically insulating substrate, wherein the at least one resistive heating element may be provided on the electrically insulating substrate.

The electrically insulating substrate may comprise any suitable material. For example, the electrically insulating substrate may comprise one or more of: paper, glass, ceramic, anodized metal, coated metal, and Polyimide. The ceramic may comprise mica, Alumina ($Al_2O_3$) or Zirconia ($ZrO_2$). Preferably, the electrically insulating substrate has a thermal conductivity of less than or equal to about 40 Watts per metre Kelvin, preferably less than or equal to about 20 Watts per metre Kelvin and ideally less than or equal to about 2 Watts per metre Kelvin.

The heater may comprise a heating element comprising a rigid electrically insulating substrate with one or more electrically conductive tracks or wire disposed on its surface. The size and shape of the electrically insulating substrate may allow it to be inserted directly into an aerosol-forming substrate. If the electrically insulating substrate is not sufficiently rigid, the heating element may comprise a further reinforcement means. A current may be passed through the one or more electrically conductive tracks to heat the heating element and the aerosol-forming substrate.

The heater may comprise an inductive heating arrangement. The inductive heating arrangement may comprise an inductor coil and a power supply configured to provide high frequency oscillating current to the inductor coil. As used herein, a high frequency oscillating current means an oscillating current having a frequency of between about 500 KHz and about 30 MHz. The heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in the device cavity. The inductor coil may substantially circumscribe the device cavity. The inductor coil may be located within the device cavity and be arranged to circumscribe an aerosol-generating article upon receipt. The inductor coil may extend at least partially along the length of the device cavity.

The heater may comprise an inductive heating element. The inductive heating element may be a susceptor element. As used herein, the term 'susceptor element' refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material.

A susceptor element may be arranged such that, when the aerosol-generating article is received in the cavity of the aerosol-generating device, the oscillating electromagnetic field generated by the inductor coil induces a current in the susceptor element, causing the susceptor element to heat up. The aerosol-generating device is preferably capable of generating a fluctuating electromagnetic field having a magnetic field strength (H-field strength) of between 1 and 5 kilo amperes per metre (kA m), preferably between 2 and 3 kA/m, for example about 2.5 kA/m. The electrically-operated aerosol-generating device is preferably capable of generating a fluctuating electromagnetic field having a frequency of between 1 and 30 MHZ, for example between 1 and 10 MHz, for example between 5 and 7 MHz.

A susceptor element may be located in the aerosol-generating article. The susceptor element is preferably located in contact with the aerosol-forming substrate. The susceptor element may be located in or within the aerosol-forming substrate.

A susceptor element may be located in the aerosol-generating device. The susceptor element may be located in the cavity. The aerosol-generating device may comprise only one susceptor element. The aerosol-generating device may comprise a plurality of susceptor elements.

The susceptor element may be arranged to heat the outer surface of the aerosol-forming substrate. The susceptor element may be arranged for insertion into an aerosol-forming substrate when the aerosol-forming substrate is received within the cavity.

The susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Some susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than about 90 percent of ferromagnetic or paramagnetic materials. Some elongate susceptor elements may be heated to a temperature in excess of about 250 degrees Celsius.

The susceptor element may comprise a non-metallic core with a metal layer disposed on the non-metallic core. For example, the susceptor element may comprise metallic tracks formed on an outer surface of a ceramic core or substrate.

The susceptor element may comprise a susceptor sleeve to heat the aerosol-generating article, preferably the aerosol-generating element. The susceptor element may define a chamber for receiving the aerosol-generating article. The susceptor element may circumscribe at least a portion of the aerosol-generating article when the article is received within the susceptor element. The susceptor element may circumscribe at least the aerosol-generating element or substrate when the article is received within the susceptor element. The susceptor element may comprise a tube. The susceptor element may comprise a tube having a partially or totally porous wall. One or more inductor coils are mounted around the susceptor element or sleeve. A pair of inductor coils are mounted around the susceptor element or sleeve. The aerosol-generating article may not comprise an internal susceptor.

The aerosol-generating device may comprise at least one resistive heating element and at least one inductive heating element. The aerosol-generating device may comprise a combination of resistive heating elements and inductive heating elements.

The aerosol-generating system may also comprise a mouthpiece element or tube that is connectable to the aerosol-generating device or the aerosol-generating article. The mouthpiece element may comprise or be made from a hollow tube of a cardboard, plastic, polymeric or paper material. The mouthpiece element may be made from a biodegradable material. Upon insertion of one or more aerosol-generating articles or rods into the aerosol-generating device, the aerosol-generating article or rod may not be arranged for a user to directly puff on them, particularly if the aerosol-generating article only comprises an aerosol-generating rod and does not include a mouthpiece filter or a downstream section at all. Instead, the user may connect or couple the separate mouthpiece element to either the downstream end of the aerosol-generating rod that is exposed at an open end of the device cavity or the open, proximal end of the device cavity. Such a mouthpiece element or tube will guide the aerosol generated to the user.

The aerosol-generating system may comprise a plurality of aerosol-generating articles, and the heating device or aerosol-generating device is arranged to receive one or more of the plurality of aerosol-generating articles. As mentioned above, the heating device may be arranged to receive at least two aerosol-generating articles simultaneously. A user may insert into the heating device or aerosol-generating device different, relatively short aerosol-generating rods or articles each having a different type of aerosol-generating element in order to beneficially modify the final aerosol created or entrained within the air flowing through the different aerosol-generating rods. The aerosol-generating device may comprise one heater or more than one heater, a heater for each aerosol-generating article the device is arranged to receive.

The invention is defined in the claims. However, below there is provided a non-exhaustive list of non-limiting examples. Any one or more of the features of these examples may be combined with any one or more features of another example, embodiment, or aspect described herein:

Example 1. An aerosol-generating article for producing an inhalable aerosol upon heating, the aerosol-generating article comprising:

a first segment;

a second segment, wherein the second segment is permeable;

an aerosol-generating element positioned between the first segment and the second segment, the second segment being located downstream of the aerosol-generating element; and a wrapper circumscribing the first segment, the aerosol-generating element and the second segment, wherein a portion of the wrapper circumscribing the aerosol-generating element is air permeable such that the wrapper establishes a fluid communication between the exterior of the aerosol-generating article and the aerosol-generating element.

Example 2. An aerosol-generating article according to Example 1, wherein the first segment is a first plug segment.

Example 3. An aerosol-generating article according to Example 1 or 2, wherein the second segment is a second plug segment.

Example 4. An aerosol-generating article according to any preceding Example, wherein the aerosol-generating element is located downstream of the first segment.

Example 5. An aerosol-generating article according to any preceding Example, wherein the aerosol-generating element is located immediately downstream of the first segment.

Example 6. An aerosol-generating article according to any preceding Example, wherein the second segment is located immediately downstream of the aerosol-generating element.

Example 7. An aerosol-generating article according to any preceding Example, wherein the aerosol-generating element is positioned immediately between the first segment and the second segment.

Example 8. An aerosol-generating article according to any preceding Example, wherein the first segment is a first filter segment.

Example 9. An aerosol-generating article according to any preceding Example, wherein the second segment is a second filter segment.

Example 10. An aerosol-generating article according to any preceding Example, wherein the air permeability of the permeable portion of the wrapper is at least 2500 Coresta Units.

Example 11. An aerosol-generating article according to any preceding Example, wherein the air permeability of the permeable portion of the wrapper is at least 5000 Coresta Units.

Example 12. An aerosol-generating article according to any preceding Example, wherein at least 50 percent of the portion of the wrapper circumscribing the aerosol-generating element is air permeable.

Example 13. An aerosol-generating article according to any preceding Example, wherein the basis weight of the wrapper is at least 10 grams per square metre (gsm).

Example 14. An aerosol-generating article according to any one of Examples 1 to 10, wherein the air permeability of the permeable portion of the wrapper is at least 2500 Coresta Units, preferably at least 5000 Coresta Units, and wherein at least 50 percent of the portion of the wrapper circumscribing the aerosol-generating element is air permeable.

Example 15. An aerosol-generating article according to any preceding Example, wherein the entirety of the portion of the wrapper circumscribing the aerosol-generating element is air permeable.

Example 16. An aerosol-generating article according to any preceding Example, wherein the aerosol-generating element is visible through the wrapper.

Example 17. An aerosol-generating article according to any preceding Example, wherein the portion of the wrapper circumscribing the aerosol-generating element is translucent or transparent.

Example 18. An aerosol-generating article according to Example 17, wherein the light transmission of the portion of the wrapper circumscribing the aerosol-generating element is at least 40 percent, preferably at least 50 percent.

Example 19. An aerosol-generating article according to any preceding Example, wherein the first plug segment is impermeable.

Example 20. An aerosol-generating article according to any one of Examples 1 to 17, wherein the first plug segment is permeable.

Example 21. An aerosol-generating article according to Example 20, wherein the resistance to draw (RTD) per unit length of the first plug segment is between about 0 mm $H_2O$ per mm and about 3 mm $H_2O$ per mm.

Example 22. An aerosol-generating article according to any preceding Example, wherein the RTD per unit length of the second plug segment is between about 0 mm $H_2O$ per mm and about 3 mm $H_2O$ per mm.

Example 23. An aerosol-generating article according to any one of the preceding Examples, further comprising a susceptor element, wherein the susceptor element is located within the aerosol-generating element or circumscribes the aerosol-generating element.

Example 24. An aerosol-generating article according to any one of the preceding Examples, the aerosol-generating element comprises a tobacco material and an aerosol former.

Example 25. An aerosol-generating article according to Example 24, wherein the tobacco material comprises one or more of homogenised tobacco material, tobacco cast leaf and reconstituted tobacco.

Example 26. An aerosol-generating article according to any one of the preceding Examples, wherein the aerosol-generating element comprises non-tobacco plant material.

Example 27. An aerosol-generating article according to any one of Examples 1 to 23, wherein the aerosol-generating element comprises a porous substrate impregnated with a liquid or gel.

Example 28. An aerosol-generating article according to Example 27, wherein the gel comprises an alkaloid compound, an aerosol former and at least one gelling agent.

Example 29. An aerosol-generating article according to any preceding Example, wherein the wrapper is impregnated with a flavourant.

Example 30. An aerosol-generating article according to any one of the preceding Examples, wherein a length of the first plug segment or the second plug segment is between 2 millimetres and 10 millimetres.

Example 31. An aerosol-generating article according to any one of the preceding Examples, wherein a length of the aerosol-generating element is between 5 millimetres and 25 millimetres.

Example 32. An aerosol-generating system comprising an aerosol-generating article according to any preceding Example and a heating device arranged to receive the aerosol-generating article.

Example 33. An aerosol-generating system according to Example 32, wherein the heating device is configured to externally heat the aerosol-generating article when received within the aerosol-generating device.

Example 34. An aerosol-generating system according to Example 32 or 33, further comprising a mouthpiece element connectable to the aerosol-generating device or the aerosol-generating article.

Example 35. An aerosol-generating system according to any one of Examples 32 to 34 comprising a plurality of aerosol-generating articles, each one in accordance with any one of Examples 1 to 31, wherein the heating device is arranged to receive one or more of the plurality of aerosol-generating articles.

Example 36. An aerosol-generating system according to Example 35, wherein the heating device is arranged to receive one aerosol-generating article or two aerosol-generating articles simultaneously.

In the following passages, the invention will be further described with reference to the drawings of the accompanying Figures, wherein.

Figure 1:
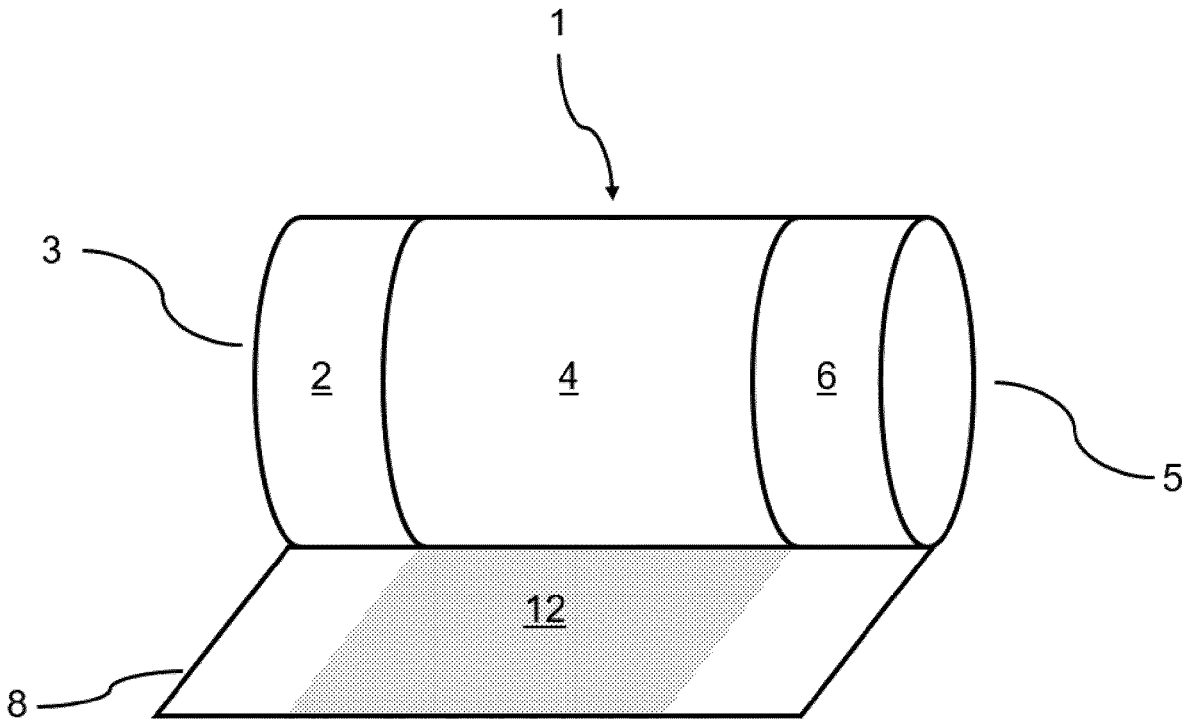
FIG. 1 shows a schematic side perspective view of a partially unwrapped aerosol-generating article in accordance with an embodiment of the invention.

An embodiment of the aerosol-generating article or rod 1 is shown in FIG. 1. The aerosol-generating rod 1 comprises a first, upstream plug segment 2 and an aerosol-generating element 4 located immediately downstream of the first plug segment 2. A second, downstream plug segment 6 is located immediately downstream of the aerosol-generating element 4. Effectively, the aerosol-generating element 4 is flanked by the two plug segments 2, 6.

The first plug segment 2, the aerosol-generating element 4 and the second plug segment 6 are in linear sequential arrangement and in axial alignment. The first plug segment 2 extends from an upstream end 3 of the aerosol-generating rod 1 to an upstream end of the aerosol-generating element 4 and the second plug segment 6 extends from a downstream end of the aerosol-generating element 4 to a downstream end of the aerosol-generating rod 1. The first plug segment 2, the aerosol-generating element 4 and the second plug segment 6 are in abutment with each other.

Figure 2:
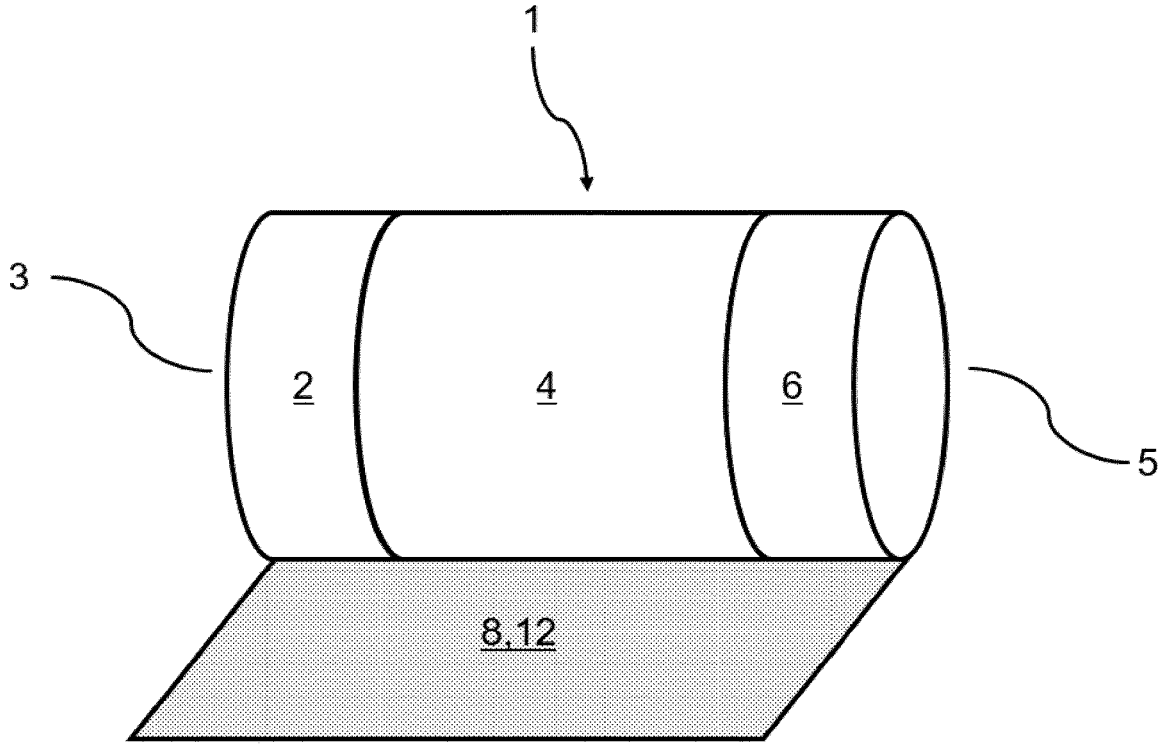
FIG. 2 shows a schematic side perspective view of another partially unwrapped aerosol-generating article in accordance with an alternative embodiment of the invention.

The aerosol-generating rod 1 shown in FIGS. 1 & 2 comprises a wrapper 8 having a permeable portion or region 12. The wrapper 8 circumscribes the first plug segment 2, the aerosol-generating element 4 and the second plug segment 6. The permeable portion 12 of the wrapper 8 is made from a tea bag material.

As shown in FIG. 1, the permeable portion 12 of the wrapper 8 extends across and along the portion of the wrapper 8 that is arranged to overlap or circumscribe the aerosol-generating element 4. The permeable region 12 is arranged to overlie the whole external surface of the aerosol-generating element 4.

As shown in the alternative arrangement of FIG. 2, the permeable portion 12 occupies the whole surface area of the wrapper 8 and is not limited to a particular region of the wrapper 8.

The contents of the aerosol-generating rod 1 (at least the aerosol-generating element 4) are visible through the permeable portion 12 of the wrapper 8.

The air permeability of the permeable portion 12 of the wrapper 8 is about 5000 Coresta units. The air permeability of the wrapper 8 is about 5000 Coresta units. The basis weight of the wrapper 8 is about 15 grams per square metre.

The aerosol-generating rod 1 comprises a first plug segment that is non-porous or non-permeable such that air may not enter the rod 1 via the upstream end 3. Air may only flow, as shown by arrows B, into the aerosol-generating element 4 via the permeable portion 12 of the wrapper 8. The aerosol generated may then flow from the aerosol-generating element 4 through the second plug segment 6 and exit the downstream end 5 of the aerosol-generating rod 1, as indicated by arrow C. Although the arrows B are shown in the top portion of FIG. 3, air may enter into the aerosol-generating rod 1 from any direction through the permeable portion 12. The RTD per unit length of the second plug segment about 3 mm $H_2O$ per mm.

Figure 3:
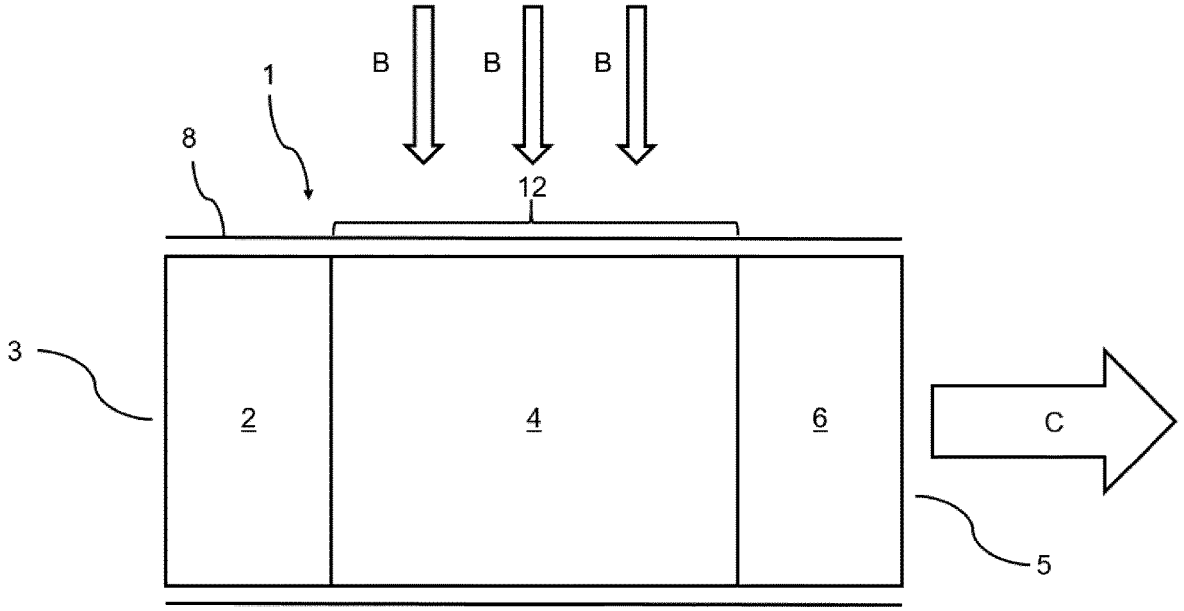
FIG. 3 shows a schematic side sectional view of another aerosol-generating article in accordance with an alternative embodiment of the invention.
Figure 4:
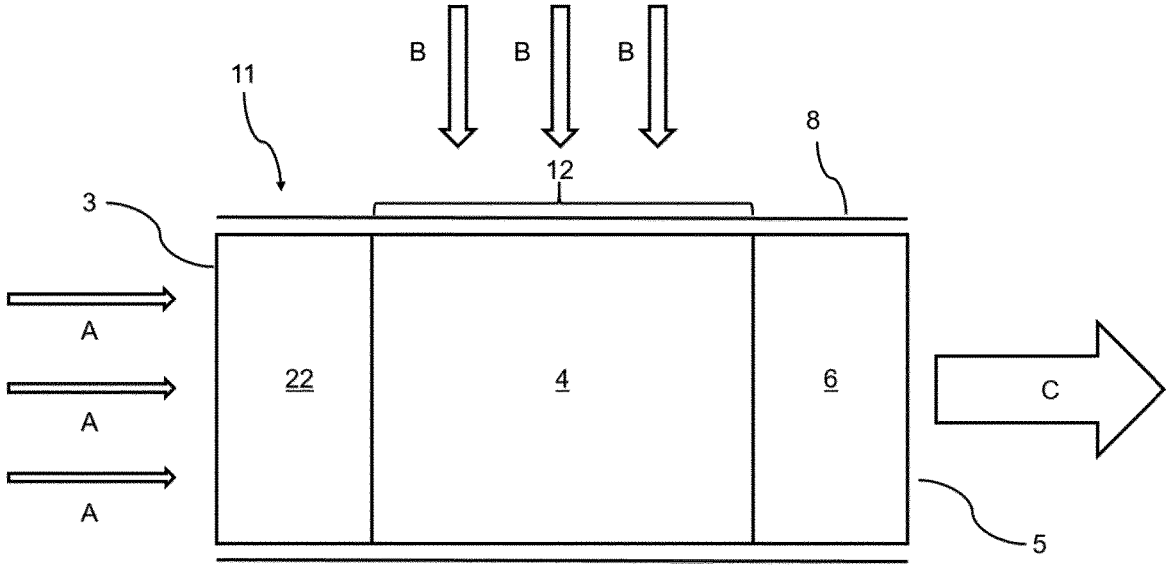
FIG. 4 shows a schematic side sectional view of another aerosol-generating article in accordance with an alternative embodiment of the invention.

An alternative embodiment of the aerosol-generating rod 11 is shown in FIG. 4, which differs from the aerosol-generating rod 1 shown in FIG. 3 in that the first plug segment 22 is air permeable so as to allow air to also enter the aerosol-generating rod 11 via the upstream end 3, as indicated by arrows A. The RTD per unit length of the first plug segment is about 3 mm $H_2O$ per mm.

The first plug segment 2, 22 has a length of about 5 millimetres. The aerosol-generating element or segment 4 has a length of about 10 millimetres. The second plug segment 6 has a length of about 5 millimetres. Thus, the aerosol-generating rod 1, 11 has an overall length of about 20 millimetres. The external diameter of the aerosol-generating rod 1, 11 is about 7.25 millimetres.

The first and second plug segments 22, 6 are made from a permeable, filtration material, such as cellulose acetate tow. The aerosol-generating element 4 comprises a tobacco material and an aerosol former. In more detail, the aerosol-generating element 4 comprises a gathered sheet of homogenised tobacco material. Alternatively, the aerosol-generating element 4 comprises a porous substrate impregnated with a liquid or a gel. The aerosol-generating element 4 preferably comprises a susceptor element (not shown) located within it.

Figure 5:
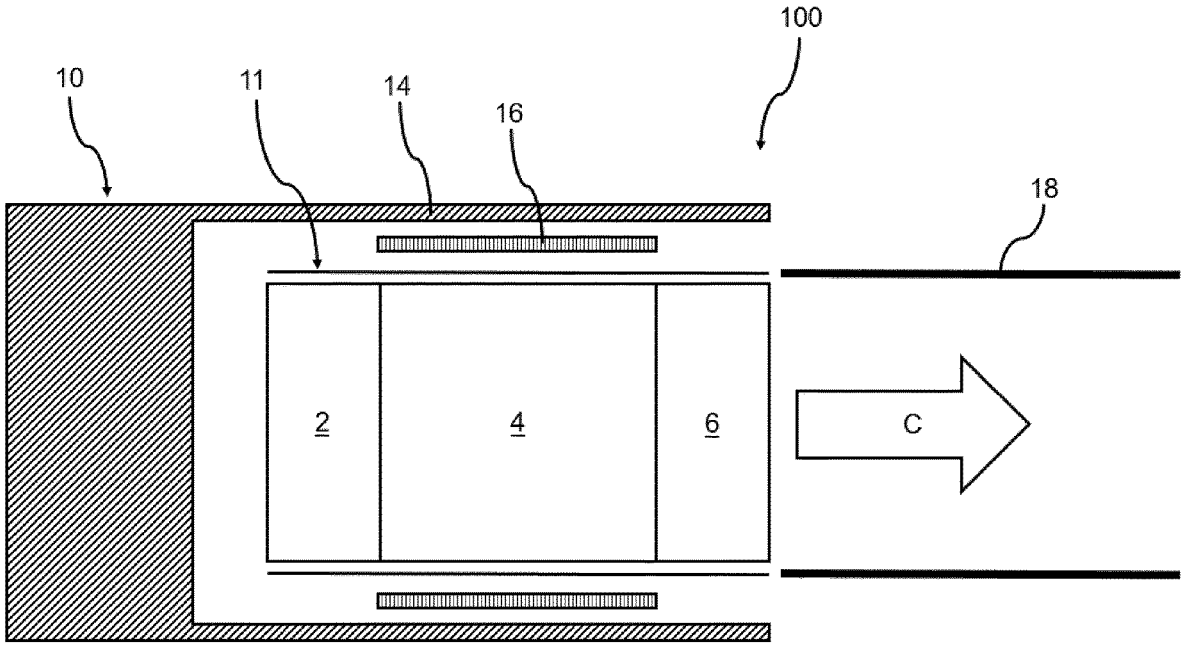
FIG. 5 shows a schematic side sectional view of an aerosol-generating system in accordance with the present disclosure.

FIG. 5 schematically shows an electrically operated aerosol-generating system 100 comprising an aerosol-generating device 10, the aerosol-generating rod or article 11 and a separable mouthpiece segment 18. FIG. 5 shows the downstream, mouth end portion of the aerosol-generating device 10 where the device cavity is defined and the aerosol-generating article 10 can be received. The aerosol-generating device 1 comprises a housing (or body), extending between a mouth end and a distal end (not shown). The housing comprises a peripheral wall 14. The peripheral wall 14 defines a device cavity for receiving an aerosol-generating article 11. The device cavity is defined by a closed, distal end and an open, mouth end. The mouth end of the device cavity is located at the mouth end of the aerosol-generating device 10. The aerosol-generating article 11 is configured to be received through the mouth end of the device cavity.

The exemplary aerosol-generating device 10 comprises an induction heater having a one or more external inductor coils (not shown) and a susceptor sleeve 16 to heat the aerosol-generating article 11, in particular the aerosol-generating element 4. The susceptor sleeve 16 comprises a tube having a porous wall. The one or more inductor coils (not shown) are mounted around the susceptor sleeve 16, which defines a cylindrical chamber for receiving the aerosol-generating article 11, as shown schematically in FIG. 5.

The aerosol-generating device 10 is powered by a battery (not shown) and is controlled by control circuitry or electronics (not shown). A user may connect the mouthpiece segment 18, comprising a hollow tube of cardboard material, to the downstream end 5 of the aerosol-generating rod 1, 11 in order to guide the generated aerosol into the user's mouth upon puffing.

It will be appreciated that the aerosol-generating rod or article 1, 11 described above may also be suitable for use with other aerosol-generating devices.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A+10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating article for producing an inhalable aerosol upon heating, the aerosol-generating article comprising:

a first plug segment comprising a solid cross-section of material;

a second plug segment comprising a solid cross-section of material, wherein the second plug segment is a filter plug segment and is permeable;

an aerosol-generating element positioned immediately between the first plug segment and the second plug segment, the second plug segment being located downstream of the aerosol-generating element; and a wrapper circumscribing the first plug segment, the aerosol-generating element, and the second plug segment, wherein a portion of the wrapper circumscribing the aerosol-generating element is air permeable such that the wrapper establishes a fluid communication between an exterior of the aerosol-generating article and the aerosol-generating element, and wherein an air permeability of the permeable portion of the wrapper is greater than 2500 Coresta units and less than 12000 Coresta units.

2. The aerosol-generating article according to claim 1, wherein the air permeability of the permeable portion of the wrapper is at least 5000 Coresta units.

3. The aerosol-generating article according to claim 1, wherein a basis weight of the wrapper is at least 10 grams per square meter (gsm).

4. The aerosol-generating article according to claim 1, wherein at least 50 percent of the portion of the wrapper circumscribing the aerosol-generating element is air permeable.

5. The aerosol-generating article according to claim 1, wherein an entirety of the portion of the wrapper circumscribing the aerosol-generating element is air permeable.

6. The aerosol-generating article according to claim 1, wherein the aerosol-generating element is visible through the wrapper.

7. The aerosol-generating article according to claim 1, wherein the portion of the wrapper circumscribing the aerosol-generating element is translucent or transparent.

8. The aerosol-generating article according to claim 7, wherein light transmission of the portion of the wrapper circumscribing the aerosol-generating element is at least 40 percent.

9. The aerosol-generating article according to claim 7, wherein light transmission of the portion of the wrapper circumscribing the aerosol-generating element is at least 50 percent.

10. The aerosol-generating article according to claim 1, wherein the first plug segment is impermeable.

11. The aerosol-generating article according to claim 1, wherein the first plug segment is permeable.

12. The aerosol-generating article according to claim 11, wherein a resistance to draw (RTD) per unit length of the first plug segment is between about 0 mm $H_2O$ per mm and about 3 mm $H_2O$ per mm.

13. The aerosol-generating article according to claim 1, wherein a resistance to draw (RTD) per unit length of the second plug segment is between about 0 mm $H_2O$ per mm and about 3 mm $H_2O$ per mm.

14. The aerosol-generating article according to claim 1, wherein a length of each of the first and the second plug segments is less than or equal to 5 mm.

15. The aerosol-generating article according to claim 1, wherein the second plug segment is formed from a cellulose material, a polylactic acid based material, a bioplastic material, or a sheet of a material formed of paper, cardboard, or polymer.

16. An aerosol-generating system comprising an aerosol-generating article according to claim 1 and a heating device arranged to receive the aerosol-generating article.

17. The aerosol-generating system according to claim 16, wherein the heating device is configured to externally heat the aerosol-generating article when received within the heating device.

* * * * *